US011721353B2

(12) United States Patent
Salehin et al.

(10) Patent No.: US 11,721,353 B2
(45) Date of Patent: Aug. 8, 2023

(54) SPATIAL AUDIO WIND NOISE DETECTION

(71) Applicant: QUALCOMM Incorporated, San Diego, CA (US)

(72) Inventors: S M Akramus Salehin, San Diego, CA (US); Lae-Hoon Kim, San Diego, CA (US); Hannes Pessentheiner, Graz (AT); Shuhua Zhang, San Diego, CA (US); Sanghyun Chi, San Diego, CA (US); Erik Visser, San Diego, CA (US); Shankar Thagadur Shivappa, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 284 days.

(21) Appl. No.: 17/128,544

(22) Filed: Dec. 21, 2020

(65) Prior Publication Data

US 2022/0199100 A1 Jun. 23, 2022

(51) Int. Cl.

| | |
|---|---|
| ***G10L 21/0232*** | (2013.01) |
| ***G10L 21/0324*** | (2013.01) |
| ***G10L 25/51*** | (2013.01) |
| ***H04R 1/40*** | (2006.01) |
| ***H04R 3/00*** | (2006.01) |
| ***H04S 3/00*** | (2006.01) |
| ***H04S 7/00*** | (2006.01) |
| *G10L 21/0216* | (2013.01) |

(52) U.S. Cl.

CPC ..... *G10L 21/0232* (2013.01); *G10L 21/0324* (2013.01); *G10L 25/51* (2013.01); *H04R 1/406* (2013.01); *H04R 3/005* (2013.01); *H04S 3/008* (2013.01); *H04S 7/30* (2013.01); *G10L 2021/02166* (2013.01); *H04R 2410/01* (2013.01); *H04R 2499/13* (2013.01); *H04S 2400/15* (2013.01)

(58) Field of Classification Search

None

See application file for complete search history.

(56) References Cited

U.S. PATENT DOCUMENTS

| | | | | |
|---|---|---|---|---|
| 9,271,075 | B2 * | 2/2016 | Matsuo | H04R 3/005 |
| 9,357,307 | B2 * | 5/2016 | Taenzer | H04R 5/04 |
| 2003/0147538 | A1 | 8/2003 | Elko | |
| 2013/0010982 | A1 | 1/2013 | Elko et al. | |
| 2017/0353809 | A1 | 12/2017 | Zhang et al. | |

OTHER PUBLICATIONS

International Search Report and Written Opinion—PCT/US2021/072943—ISA/EPO—dated Apr. 28, 2022.

(Continued)

*Primary Examiner* — Paul W Huber
(74) *Attorney, Agent, or Firm* — Moore IP

(57) ABSTRACT

A device includes one or more processors configured to obtain audio signals representing sound captured by at least three microphones and determine spatial audio data based on the audio signals. The one or more processors are further configured to determine a metric indicative of wind noise in the audio signals. The metric is based on a comparison of a first value and a second value. The first value corresponds to an aggregate signal based on the spatial audio data, and the second value corresponds to a differential signal based on the spatial audio data.

29 Claims, 14 Drawing Sheets

(56) References Cited

OTHER PUBLICATIONS

Mirabilii D., et al., "Multi-Channel Wind Noise Reduction Using the Corcos Model", ICASSP 2019—2019 IEEE International Conference on Acoustics, Speech And Signal Processing (ICASSP), IEEE, May 12, 2019 (May 12, 2019), pp. 646-650, XP033566420, DOI: 10.1109/ICASSP.2019.8683873 [retrieved on Apr. 4, 2019] the whole document.

Mirabilii D., et al., "On the Difference-to-Sum Power Ratio of Speech and Wind Noise Based on the Corcos Model", arxiv.org, Cornell University Library, 201 Olin Library Cornell University Ithaca, NY14853, Oct. 23, 2018 (Oct. 23, 2018), XP081553827, pp. 1-5, DOI: 10.1109/ICSEE.2018.8645977 the whole document.

* cited by examiner

SPATIAL AUDIO WIND NOISE DETECTION

I. FIELD

The present disclosure is generally related to sound event classification and more particularly to detecting wind noise in spatial audio.

II. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, audio recording, audio and/or video conferencing, and an audio file player. Also, such devices can process executable instructions, including software applications, such as a web browser application, that can be used to access the Internet. As such, these devices can include significant computing capabilities, including, for example audio signal processing. For such devices, wind noise can be problematic for audio captured outdoors.

III. SUMMARY

In a particular aspect, a device includes one or more processors configured to obtain audio signals representing sound captured by at least three microphones and determine spatial audio data based on the audio signals. The one or more processors are further configured to determine a metric indicative of wind noise in the audio signals. The metric is based on a comparison of a first value and a second value, where the first value corresponds to an aggregate signal based on the spatial audio data and the second value corresponds to a differential signal based on the spatial audio data.

In a particular aspect, a method includes obtaining audio signals representing sound captured by at least three microphones and determining spatial audio data based on the audio signals. The method also includes determining a metric indicative of wind noise in the audio signals. The metric is based on a comparison of a first value and a second value, where the first value corresponds to an aggregate signal based on the spatial audio data and the second value corresponds to a differential signal based on the spatial audio data.

In a particular aspect, a device includes means for determining spatial audio data based on audio signals representing sound captured by at least three microphones. The device further includes means for determining a metric indicative of wind noise in the audio signals. The metric is based on a comparison of a first value and a second value, where the first value corresponds to an aggregate signal based on the spatial audio data and the second value corresponds to a differential signal based on the spatial audio data.

In a particular aspect, a non-transitory computer-readable storage medium stores instructions that are executable by one or more processors to cause the one or more processors to determine spatial audio data based on audio signals representing sound captured by at least three microphones. The instructions further cause the one or more processors to determine a metric indicative of wind noise in the audio signals. The metric is based on a comparison of a first value and a second value, where the first value corresponds to an aggregate signal based on the spatial audio data and the second value corresponds to a differential signal based on the spatial audio data.

Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

Figure 21:
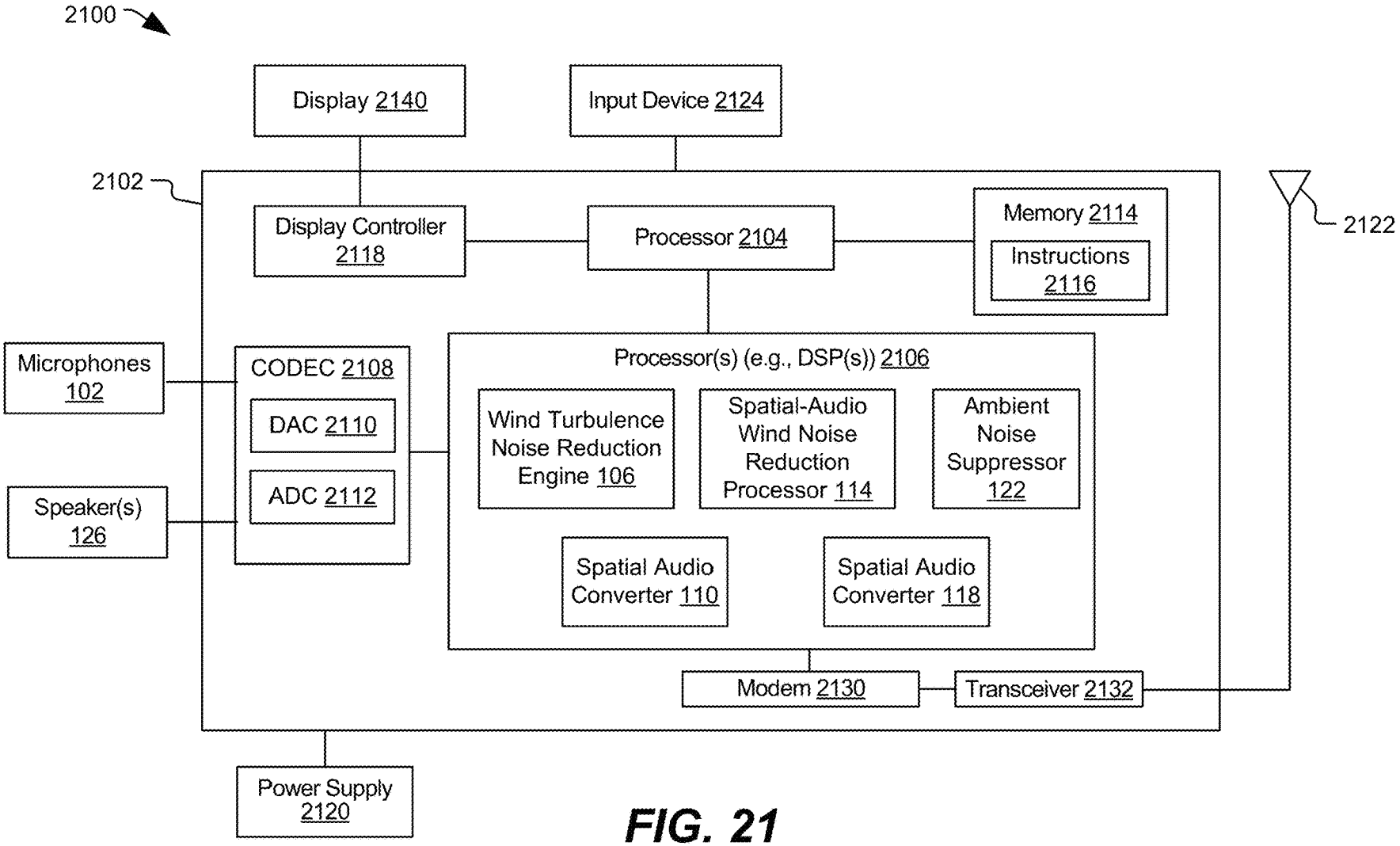

FIG. 21 a block diagram of a particular illustrative example of a device that is operable to perform wind noise detection and reduction according to a particular aspect.

V. DETAILED DESCRIPTION

Wind noise can be problematic for audio captured outdoors. Aspects disclosed herein enable detection of wind noise and reduction of wind noise in audio data, such as spatial audio data. In some aspects, wind noise is detected based on analysis of the spatial audio data. In some aspects, detected wind noise is mitigated or reduced by processing the spatial audio data. For example, particular channels of the spatial audio data may be de-emphasized. As another example, low-frequency components of the spatial audio data may be filtered out without degrading the audio and spatial quality of the capture.

In a particular aspect, a wind noise metric is determined based on a comparison of two values including a first value corresponding to an aggregate signal based on the spatial audio data and a second value corresponding to a differential signal based on the spatial audio data. In some implementations, the spatial audio data includes ambisonics data. For example, when the ambisonics data includes first order ambisonics, the ambisonics data may be encoded in a W-channel (including omnidirectional sound information), an X-channel (including differential sound information representing a front/back sound), a Y-channel (including differential sound information representing a left/right sound), and a Z-channel (including differential sound information representing a up/down sound). In this example, the aggregate signal corresponds to the omnidirectional sound information (e.g., the W-channel), and the differential signal corresponds to one of the directional channels (e.g., the X-channel, the Y-channel, or the Z-channel).

In some implementations, the spatial audio data includes two or more beamformed audio channels corresponding to beams offset by at least a threshold angle (e.g., 90 to 180 degrees). In such implementations, the aggregate signal corresponds to a sum based on two beams, and the differential signal corresponds to a difference based on the two beams.

A value of the metric indicates presence of wind noise and, when present, the extent of the wind noise. In some implementations, values of the metric in particular frequencies or frequency bands can be used to determine response actions used to reduce the wind noise. For example, band-specific values of the metric may be used to determine band-specific filter parameters used to reduce the wind noise. As another example, when a frequency-specific value of the metric exceeds a threshold, gain applied to one or more channels of audio data may be reduced to limit the wind noise.

Figure 1:
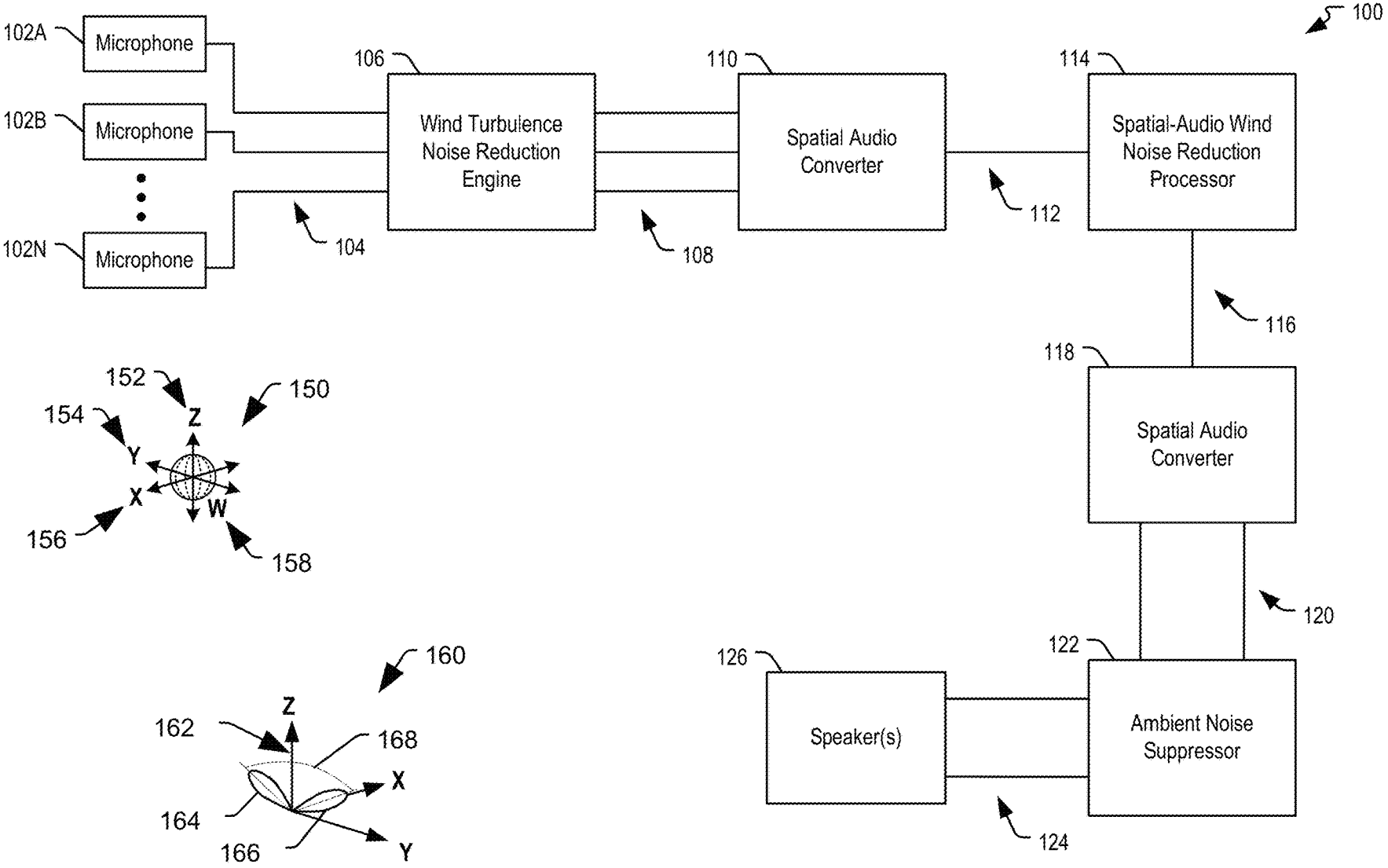
FIG. 1 is a block diagram of an example of a device that is configured to detect and reduce wind noise in spatial audio data.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. Further, some features described herein are singular in some implementations and plural in other implementations. To illustrate, FIG. 1 depicts a device 100 including one or more speakers ("speaker(s) 126" in FIG. 1), which indicates that in some implementations the device 100 includes a single speaker 126 and in other implementations the device 100 includes multiple speakers 126. For ease of reference herein, such features are generally introduced as "one or more" features and are subsequently referred to in the singular or optional plural (generally indicated by terms ending in "(s)") unless aspects related to multiple of the features are being described.

The terms "comprise," "comprises," and "comprising" are used herein interchangeably with "include," "includes," or "including." Additionally, the term "wherein" is used interchangeably with "where." As used herein, "exemplary" indicates an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

As used herein, "coupled" may include "communicatively coupled," "electrically coupled," or "physically coupled," and may also (or alternatively) include any combinations thereof. Two devices (or components) may be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled may be included in the same device or in different devices and may be connected via electronics, one or more connectors, or inductive coupling, as illustrative, non-limiting examples. In some implementations, two devices (or components) that are communicatively coupled, such as in electrical communication, may send and receive electrical signals (digital signals or analog signals) directly or indirectly, such as via one or more wires, buses, networks, etc. As used herein, "directly coupled" refers to two devices that are coupled (e.g., communicatively coupled, electrically coupled, or physically coupled) without intervening components.

In the present disclosure, terms such as "determining," "calculating," "estimating," "shifting," "adjusting," etc. may be used to describe how one or more operations are performed. It should be noted that such terms are not to be construed as limiting and other techniques may be utilized to perform similar operations. Additionally, as referred to herein, "generating," "calculating," "estimating," "using," "selecting," "accessing," and "determining" may be used interchangeably. For example, "generating," "calculating," "estimating," or "determining" a parameter (or a signal) may refer to actively generating, estimating, calculating, or determining the parameter (or the signal) or may refer to using, selecting, or accessing the parameter (or signal) that is already generated, such as by another component or device.

FIG. 1 is a block diagram of an example of a device 100 that is configured to detect and reduce wind noise in spatial audio data. In the example illustrated in FIG. 1, the device 100 includes three microphones 102, including a microphone 102A, a microphone 102B, and a microphone 102N, configured to generate audio data 104. In other implementations, the device 100 includes more than three microphones. In still other examples, the device 100 includes fewer than three microphones. To illustrate, in some examples, the device 100 is configured to obtain the audio data 104 captured by multiple remote microphones via an interface (e.g., an audio input port) or via an intermediary device (e.g., a computing device, a sound board, etc.) in which case the device 100 may not include any microphones 102.

In the example illustrated in FIG. 1, the audio data 104 is processed at a wind turbulence noise reduction engine 106 to remove or reduce high-frequency wind noise associated with wind turbulence. In FIG. 1, the wind turbulence noise reduction engine 106 generates output signals 108 corresponding to the audio data 104 after mitigation of wind turbulence noise. In a particular aspect, the wind turbulence noise reduction engine 106 operates on individual streams of the audio data 104. To illustrate, if the audio data 104 represents N streams of audio information input to the wind turbulence noise reduction engine 106 (where Nis a positive integer), the output signals 108 include N streams of audio information, each corresponding to a respective one of the N streams of audio data 104 input to the wind turbulence noise reduction engine 106 with reduced high-frequency wind noise due to wind turbulence. As one example, the wind turbulence noise reduction engine 106 may identify a first signal component of one of the audio data 104 signals that has more wind turbulence noise than a second signal component of the same audio 104 signal and may synthesize a third signal component to replace the first signal component to generate a corresponding output signal 108. In this example, the third signal component has less wind turbulence noise than the first signal component, and the output signal 108 in this example may be generated to have the same frequency response as the corresponding audio data 104 signal. In another aspect, the wind turbulence noise reduction engine 106 operates on two or more streams of the audio data 104 together to identify and/or remove wind turbulence noise. To illustrate, the wind turbulence noise reduction engine 106 may generate one or more of the output signals 108 by adjusting an inter-channel phase difference between two or more of the audio data 104 signals.

In FIG. 1, the output signals 108 of the wind turbulence noise reduction engine 106 are provided to a spatial audio converter 110 to generate spatial audio data 112. In a particular aspect, the spatial audio data 112 includes ambisonics data, such as first order ambisonics data or higher order ambisonics data. To illustrate, the spatial audio converter 110 may perform a three-dimensional spherical harmonic decomposition of a sound field represented by the output signals 108 to generate ambisonics coefficients. In a particular aspect, the spatial audio data 112 represents two or more audio beams. To illustrate, the spatial audio converter 110 may perform beamforming (e.g., spatial filtering) using the sound field represented by the output signals 108 to generate the two or more audio beams.

FIG. 1 shows a first example 150 to illustrate spatial audio encoding using first order ambisonics. In the first example 150, the spatial audio data includes an X-channel or X-coefficients that represent differential sound along an X-axis 156. In the first example 150, the X-axis 156 refers to a front-to-back direction relative to an observer, and the X-channel encodes a difference between sound in front of the observer and sound behind the observer. The first example 150 also illustrates a Y-channel or Y-coefficients that represent differential sound along a Y-axis 154. In the first example 150, the Y-axis 154 refers to a right-and-left direction relative to the observer, and the Y-channel encodes a difference between sound to the right of the observer and sound to the left of the observer. The first example 150 also illustrates a Z-channel or Z-coefficients that represent differential sound along a Z-axis 152. In the first example 150, the Z-axis 152 refers to an up-and-down direction relative to the observer, and the Z-channel encodes a difference between sound above the observer and sound below the observer. The first example 150 further illustrates a W-channel or W-coefficients that represent omnidirectional sound in an area W 158 around the observer. In the first example 150, the W-channel encodes an aggregate of sound around the observer.

FIG. 1 shows a second example 160 to illustrate spatial audio encoding using beamforming. In the second example 160, two beams 164 and 166 are generated to represent sound from particular directions within a three-dimensional space, which is represented in the second example 160 by a Cartesian coordinate system that includes an X-axis, a Y-axis, and a Z-axis. In the second example 160, the beams 164 and 166 correspond to different directions which are angularly offset by an angle 168.

It is noted that while ambisonics coefficients of the first example 150 and the axes of the second example 160 each use X-, Y-, and Z-labels, the labels are the same due to labeling conventions and do not necessarily mean the same thing in the first example 150 and the second example 160. For example, as noted above, in B-format notation for first order ambisonics, the X-coefficient represents a difference between sound in front of the observer and sound behind the observer; whereas, in Cartesian coordinate notation, the X-axis merely indicates a direction and is observer independent. Accordingly, the X-, Y-, and Z-labels of the first and second examples 150, 160 are distinct and should not be confused.

In FIG. 1, the spatial audio data 112 is provided to a spatial-audio wind noise reduction processor 114. The spatial-audio wind noise reduction processor 114 is configured to determine a metric indicative of wind noise in the spatial audio data 112. For example, the spatial-audio wind noise reduction processor 114 may determine a value of the metric based on a comparison of a first value and a second value derived from the spatial audio data 112. In this example, the first value corresponds to an aggregate signal based on the spatial audio data 112, and the second value corresponds to a differential signal based on the spatial audio data 112. In this example, the value of the metric may be output to a user (e.g., to indicate that excessive wind noise is present), used to trigger other processing, etc.

When the spatial audio data 112 includes the two or more audio beams 164, 166, the aggregate signal may be determined as a sum of two audio beams, and the differential signal may be determined as a difference of the two audio beams. The two audio beams used to generate the aggregate signal and the differential signal are angularly offset from one another, such as by 90 degrees to 180 degrees. As a specific example of the second aspect, when spatial audio data 112 includes the two audio beams 164, 166, a value of the metric may be determined as a ratio of a sum of values of the two audio beams 164, 166 to a difference of the values of the two audio beams 164, 166.

In a particular aspect, the spatial-audio wind noise reduction processor 114 uses one or more values of the metric to configure filter parameters to remove at least a portion of the wind noise to generate reduced-wind-noise audio data 116. Additionally, or in the alternative, in some implementations, the spatial-audio wind noise reduction processor 114 detects wind noise by comparing values of the metric to one or more wind detection thresholds. In some such implementations, gain applied to one or more channels of the spatial audio data 112 is reduced when significant wind noise, represented by particular values of the metric, is detected.

In the example of FIG. 1, the reduced-wind-noise audio data 116 is provided to a spatial audio converter 118 to generate binaural or monaural audio data 120 based on the reduced-wind-noise audio data 116. In some implementations, the binaural or monaural audio data 120 is provided to an ambient noise suppressor 122. The ambient noise suppressor 122 is configured to reduce stationary high frequency wind noise to generate reduced-wind-noise audio data 124. In the example of FIG. 1, the reduced-wind-noise audio data 124 can be provided to one or more speakers 126 to generate sound output.

In some implementations, one or more of the components or operations illustrated in FIG. 1 are omitted. For example, the wind turbulence noise reduction engine 106, the ambient noise suppressor 122, or both, may be omitted in some implementations. In such implementations, wind noise in the audio data 104 may still be detected and/or reduced by the spatial-audio wind noise reduction processor 114. As another example, the spatial audio converter 110, the spatial audio converter 118, or both, may be omitted. To illustrate, in such implementations, the spatial audio data 112 is generated by another device and is obtained by the spatial-audio wind noise reduction processor 114 from the other device, from an intermediate device, or from a memory device. Additionally, or in the alternative, in such implementations, the reduced-wind-noise audio data 116 is provided to another device to generate the binaural or monaural audio data 120, the reduced-wind-noise audio data 124, or both. As another example, the speaker(s) 126 may be omitted, in which case the reduced-wind-noise audio data 124 may be sent to another device or to external speakers for playback or may be stored (e.g., in a memory device) for later playback.

In the example illustrated in FIG. 1, the device 100 includes at least three microphones 102 which are spaced apart appropriately to enable spatial audio conversion. For example, in a particular implementation, at least two of the microphones (e.g., the microphone 102A and the microphone 102N) are spaced apart by at least 0.5 centimeters. In other implementations, at least two of the microphones (e.g., the microphone 102A and the microphone 102N) are spaced apart by at least 2.0 centimeters. Other wind noise reduction techniques, such as cross correlation can be effective at removing wind noise when the microphones 102 are closer together than 0.5 centimeters. Accordingly, in some aspects, the device 100 of FIG. 1 may use cross correlation to remove wind noise from microphones that are less than 0.5 centimeters apart or that are between 0.5 centimeters and 2.0 centimeters apart, may use the spatial-audio wind noise reduction processor 114 to remove wind noise from microphones that are more than 0.5 centimeters apart or more than 2.0 centimeters apart. In some implementations, the device 100 may be configured to switch between cross correlation wind noise reduction and spatial-audio wind noise reduction. For example, when a first set of the microphones 102 provide the audio data 104, the device 100 uses cross correlation wind noise reduction based on configuration settings or information indicating that the first set of the microphones 102 are spaced apart by less than a threshold. In this example, when a second set of the microphones 102 provide the audio data 104, the device 100 uses the spatial-audio wind noise reduction processor 114 to reduce wind noise based on the configuration settings or information indicating that the second set of the microphones 102 are spaced apart by more than the threshold.

Figure 2:
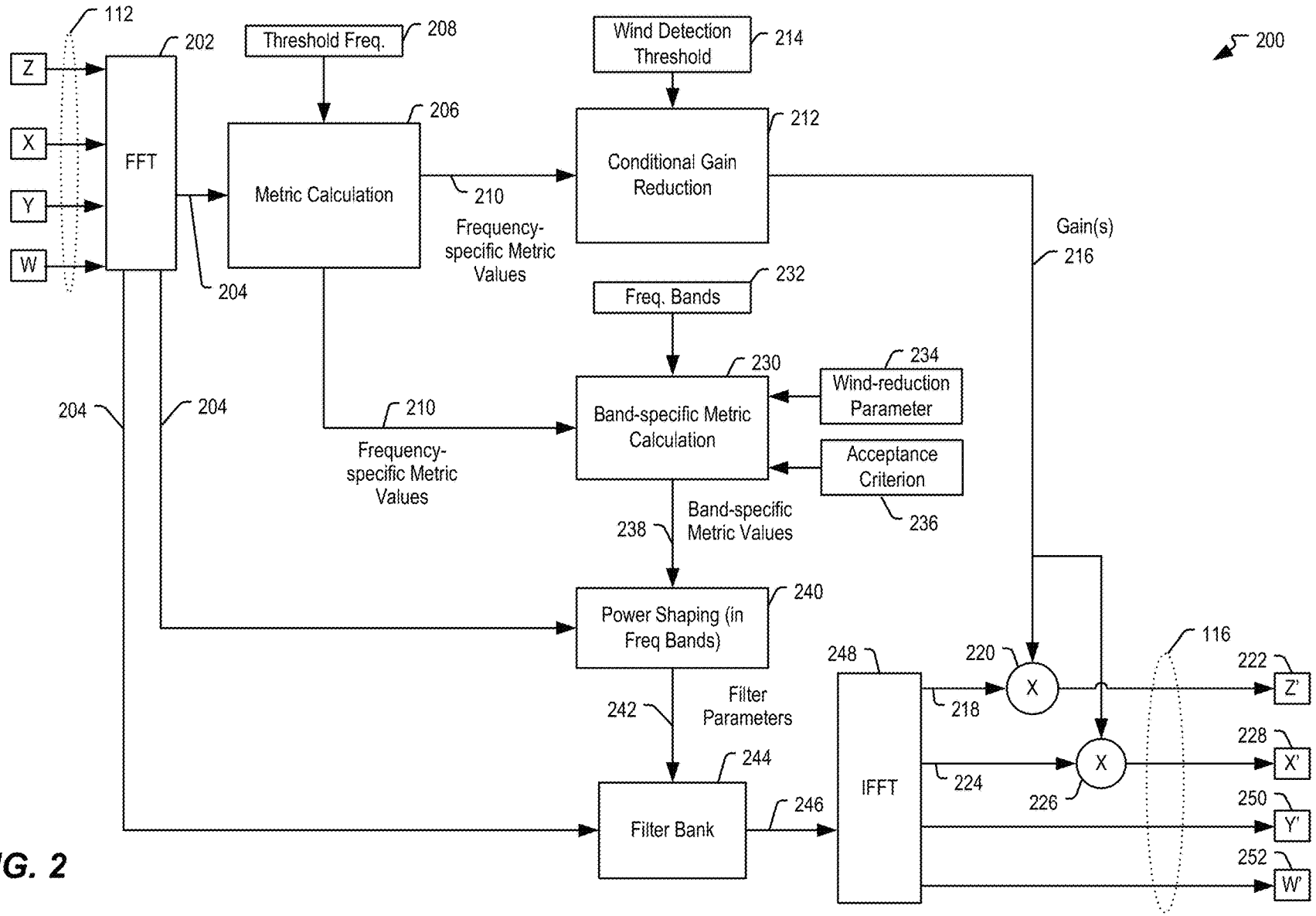
FIG. 2 is a block diagram that illustrates particular aspects of a device to detect and reduce wind noise in spatial audio data according to a particular example.

FIG. 2 is a block diagram that illustrates particular aspects of a device 200 to detect and reduce wind noise in spatial audio data according to a particular example. The device 200 in the example of FIG. 2 may include, be included within, or correspond to the spatial-audio wind noise reduction processor 114 of FIG. 1 in an implementation in which the spatial audio data 112 includes ambisonics data. For example, in FIG. 2, the spatial audio data 112 includes a Z-channel (representing Z-coefficients), an X-channel (representing X-coefficients), a Y-channel (representing Y-coefficients), and a W-channel (representing W-coefficients). In other examples, the spatial audio data 112 includes higher order ambisonics data.

In FIG. 2, the spatial audio data 112 is transformed to a frequency domain to generate frequency-domain spatial audio data 204 using a Fast-Fourier transform (FFT) 202 or another time domain to frequency domain transform operation. The frequency-domain spatial audio data 204 indicate, for a time-windowed sample of the spatial audio data 112, amplitudes associated with various frequencies or frequency bins.

At metric calculation block 206, at least two channels of the frequency-domain spatial audio data 204 are used to calculate frequency-specific values of the metric ("frequency specific metric values" 210 in FIG. 2). For example, a signal power of each time-windowed sample at each frequency is determined. To illustrate, the signal power (P) at each frequency (f) and time-windowed sample (t) may be determined using Equation 1:

$$P_t(f)=\alpha*S(f)*\mathrm{conj}(S(f))+(1-\alpha)*P_{t-1}(f) \qquad \text{Equation 1}$$

where $P_t(f)$ is signal power at time t and frequency f, $\alpha$ is a smoothing factor, S(f) is the complex power at frequency f and $P_{t-1}(f)$ is signal power of the frequency at the prior time t−1. For a particular frequency and time sample, a frequency-specific metric value 210 is determined as a ratio of a power of the W-channel at the particular frequency and time sample to a power of one of the differential channels (e.g., the Y-channel, the X-channel, or the Z-channel) at the particular frequency and time sample. For example, when ambisonics coefficients are used to represent the spatial audio data 112, each frequency-specific value of the metric may represent an omnidirectional (e.g., W-channel) signal power at a particular frequency divided by differential (e.g., Y-channel) signal power at the particular frequency. In a particular aspect, the frequency-specific metric values 210 are determined for each frequency that is less than a threshold frequency 208. In this example, the metric indicates power for wind noise reduction, which corresponds to a gain that would be applied at the frequency to remove wind noise. Thus, in this example, higher values of the metric indicate that less of the signal is due to wind noise, and a lower value of the metric indicates that more of the signal is due to wind noise.

In a particular aspect, the frequency-specific metric values 210 are compared to one or more wind detection thresholds 214 at a conditional gain reduction block 212. In this aspect, a gain 216 applied to one or more channels of the audio data may be adjusted to reduce wind noise responsive to any of the frequency-specific metric values 210 satisfying (e.g., being less than or equal to) the wind detection threshold(s) 214. The wind detection threshold(s) 214 is a static or tunable value between 0 and 1.

In the example illustrated in FIG. 2, the gain(s) 216 that are adjusted by the conditional gain reduction block 212 include an X-channel gain and a Z-channel gain. Some audio capture devices and/or audio processing devices tend to boost low-frequency components of the X- and Z-coefficients of spatial audio data in a manner than can increase wind noise. Thus, decreasing gain applied to the X-channel, the Z-channel, or both, can reduce wind noise in output audio. Additionally, human perception tends to rely more on the Y-channel and W-channel for spatial cues than on the X-channel and the Z-channel. Accordingly, reduction of gain applied to the X-channel, the Z-channel, or both, results in a better user experience than does reduction of either the Y-channel and W-channel. In other examples, only the X-channel gain or only the Z-channel gain is adjusted. In still other examples, the Y-channel gain is adjusted in addition to, or instead of, one or both of the X-channel gain and the Z-channel gain.

In a particular aspect, the frequency-specific metric values 210 are used to calculate band-specific metric values 238 at a band-specific metric calculation block 230. For example, the frequency-specific metric values 210 are grouped by frequency bands 232 and a weighted sum is used to calculate a band-specific metric value for each frequency band 232. In a particular implementation, the frequency bands 232 have a bandwidth of 500 Hertz (Hz). In other implementations, the frequency bands 232 are larger (e.g., 1000 Hz) or smaller (e.g., 250 Hz). In still other implementations, different frequency bands 232 may have different bandwidths.

In a particular implementation, a band-specific metric value 238 for a particular frequency band may be calculated using Equation 2:

$$\text{Metric}_{band}=\Sigma_{f_lower}^{f_upper}\text{Metric}(f)^{wr_parameter} \qquad \text{Equation 2}$$

Where $\text{Metric}_{band}$ is the band-specific metric value 238 for the frequency band between an upper frequency value (f_upper) and a lower frequency value (f_lower), Metric(f) is a frequency-specific value of the metric within the frequency band, and wr_parameter is a value of a wind-reduction parameter 234. The wind-reduction parameter 234 is a preconfigured or tunable value that affects how aggressively the device 200 reduces the wind noise, especially in lower frequency bands. For example, larger values of the wind-reduction parameter 234 result in more reduction in low frequency wind noise and smaller values of the wind-reduction parameter 234 result in less reduction in low frequency wind noise. As one example, a default value of 0.5 may be used for the wind-reduction parameter 234; however, the value of the wind-reduction parameter 234 may be tunable over a range of values, such as from 0.1 to 4 in a particular non-liming example.

In a particular aspect, the band-specific metric calculation block 230 may modify one or more of the frequency-specific metric values 210 before determining the band-specific metric values 238. For example, the band-specific metric calculation block 230 may compare each of the frequency-specific metric values 210 to an acceptance criterion 236. In this example, if a particular frequency-specific metric value 210 satisfies the acceptance criterion 236, the particular frequency-specific metric value 210 is determined to not represent wind noise. In this situation, the particular frequency-specific metric value 210 may be assigned a value of 1 to indicate that no wind noise is present. The acceptance criterion 236 is a pre-set or tunable value between 0 and 1. In a particular non-limiting example, the acceptance criterion 236 is between 0.6 and 0.9, and the acceptance criterion 236 is satisfied when a particular frequency-specific metric values 210 is greater than or equal to the acceptance criterion 236. To illustrate, if the acceptance criterion 236 has a value of 0.8, and the value of a particular frequency-specific metric value 210 is 0.82, the frequency-specific metric values 210 is assigned a frequency-specific metric value of 1 for purposes of determining the band-specific metric values 238.

The band-specific metric values 238 are shaped at the power shaping block 240. The shaping prevents a gain-adjusted power of a higher frequency band of the set of frequency bands from exceeding a gain-adjusted energy of a lower frequency band of the set of frequency bands. For example, the power shaping block 240 may use logic such as:

$$\text{If } \text{Metric}_{band}(\text{Band}_k)*E(\text{Band}_k, W)<\text{Metric}_{band}(\text{Band}_{k+1})*E(\text{Band}_{k+1}, W);$$

$$\text{then } \text{Metric}_{band}(\text{Band}_k)=\text{Metric}_{band}(\text{Band}_{k+1})*E(\text{Band}_{k+1}, W)/E(\text{Band}_k, W)$$

where $\text{Band}_k$ indicates a particular frequency band, $\text{Bank}_{k+1}$ indicates the next higher frequency band, $E(\text{Band}_k, W)$ is the energy of the kth frequency band in the W-channel, and $E(\text{Band}_{k+1}, W)$ is the energy of the k+1th frequency band in the W-channel, where the energy of each band in the W-channel is determined based on the frequency-domain spatial audio data 204.

The power shaped band-specific metric values 238 are used as filter parameters 242 for a filter bank 244. The filter bank 244 modifies the frequency-domain spatial audio data 204 to generate filtered frequency-domain spatial audio data 246. For example, the filter bank 244 may determine the frequency-domain spatial audio data 246 for each frequency and channel using Equation 3:

$$\text{Output}(f)=S(f)*\Sigma_{n=1}^{N}\text{Metric}(\text{Band}_n)*H_n(f) \qquad \text{Equation 3}$$

where Output(f) is the frequency-domain spatial audio data 246 for a particular frequency (f) and channel, S(f) is the frequency-domain spatial audio data 204 for the particular frequency (f) and channel, $\text{Band}_n$ is the particular band of the frequency bands 232 in which the particular frequency (f) falls, $\text{Metric}(\text{Band}_n)$ is the power shaped band specific metric for $\text{Band}_n$ of the particular channel, and H_n(f) is a transfer function for the particular frequency (f) and channel.

In FIG. 2, the frequency-domain spatial audio data 246 is transformed from the frequency domain to the time domain using an inverse Fast-Fourier transform (IFFT) 248 to generate one or more channels of the reduced-wind-noise audio data 116. For example, the IFFT 248 may perform an inverse Fast-Fourier transform or another time domain to frequency domain transform operation. The IFFT 248 of FIG. 2 outputs a W'-channel 252 which corresponds to the W-channel input to the FFT 202 with low-frequency wind noise components removed or reduced. Additionally, the IFFT 248 of FIG. 2 outputs a Y'-channel 250 which corresponds to the Y-channel input to the FFT 202 with low-frequency wind noise components removed or reduced. The IFFT 248 of FIG. 2 also outputs an X'-channel 224 which corresponds to the X-channel input to the FFT 202 with low-frequency wind noise components removed or reduced, and a Z'-channel 218 which corresponds to the Z-channel input to the FFT 202 with low-frequency wind noise components removed or reduced. In the example illustrated in FIG. 2, the gain(s) 216 may be applied to the X'-channel 224 via an amplifier 226 to generate an output X'-channel 228, to the Z'-channel 218 via an amplifier 220 to generate an output Z'-channel 222, or both, to further reduce wind-noise in the reduced-wind-noise audio data 116. In some implementation, the gain(s) 216 are gradually applied over multiple frames to limit sudden changes that can cause perceptible pops or other artifacts. In some implementations, the gain(s) 216 may be set to a value of 0, indicating that all audio is removed from the corresponding channels to which the gain(s) 216 is applied.

In some implementations, the reduced-wind-noise audio data 116 is provided to other components, such as the spatial audio converter 118 of FIG. 1, for further processing and to generate sound output (e.g., via the speaker(s) 126 of FIG. 1).

Figure 3:
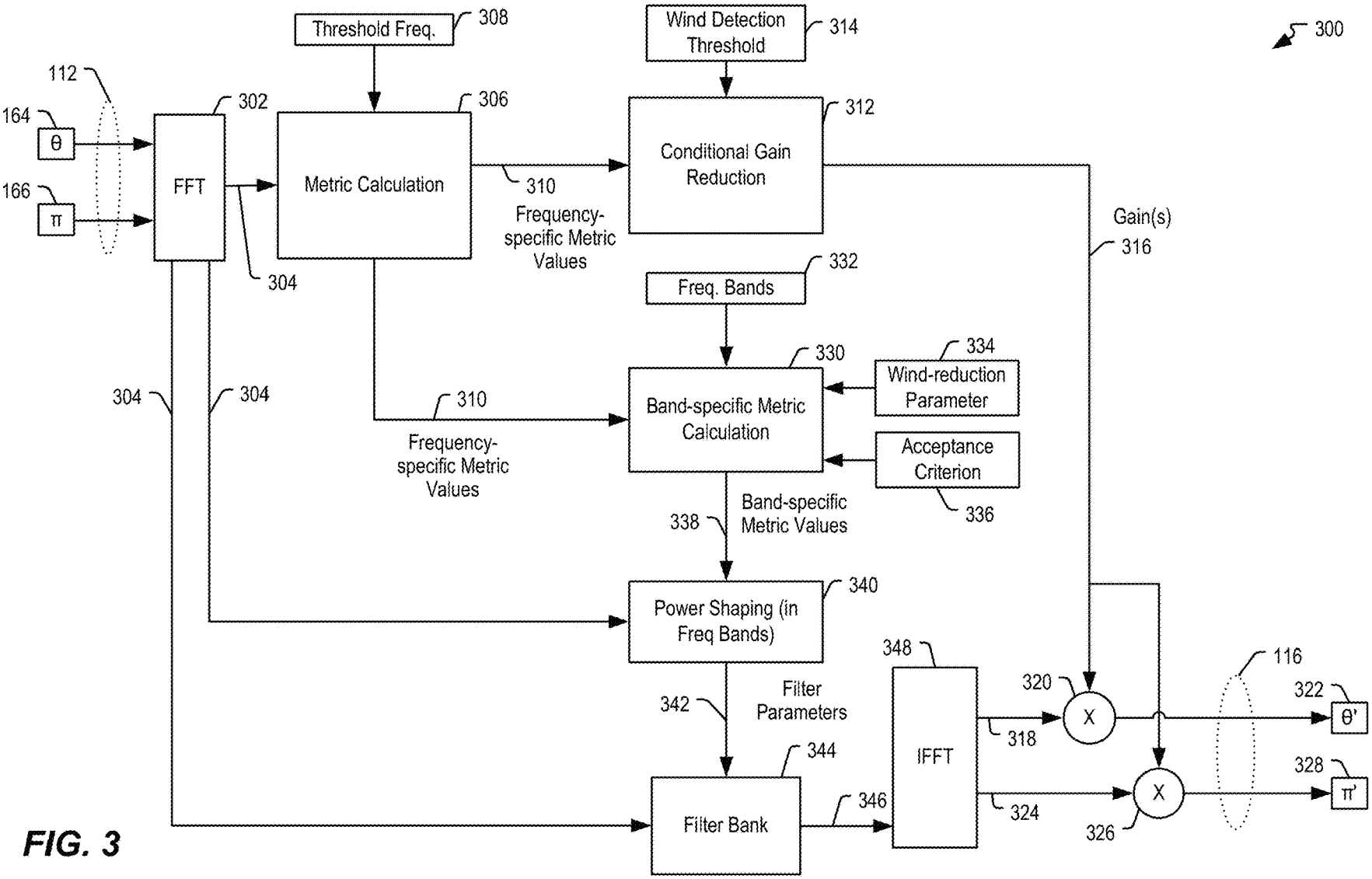
FIG. 3 is a block diagram that illustrates particular aspects of a device to detect and reduce wind noise in spatial audio data according to another particular example.

FIG. 3 is a block diagram that illustrates particular aspects of a device 300 to detect and reduce wind noise in spatial audio data according to another particular example. The device 300 in the example of FIG. 3 may include, be included within, or correspond to the spatial-audio wind noise reduction processor 114 of FIG. 1 in an implementation in which the spatial audio data 112 includes two or more beams 164, 166. For example, in FIG. 3, the spatial audio data 112 includes a θ-channel (representing data from beam 164 of FIG. 1) and an π-channel (representing data from beam 166 of FIG. 1). In other examples, the spatial audio data 112 includes data from more than two beams.

In FIG. 3, the spatial audio data 112 is transformed to a frequency domain to generate frequency-domain spatial audio data 304 using an FFT 302 or another time domain to frequency domain transform operation. The frequency-domain spatial audio data 304 indicate, for a time-windowed sample of the spatial audio data 112, amplitudes associated with various frequencies or frequency bins.

At metric calculation block 306, at least two channels of the frequency-domain spatial audio data 304 are used to calculate frequency-specific values of the metric ("frequency specific metric values" 310 in FIG. 3). For example, a signal power of each time-windowed sample at each frequency is determined. To illustrate, the signal power at each frequency and time-windowed sample may be determined using Equation 1, above. For a particular frequency and time sample, a frequency-specific metric value 310 is determined as a ratio of a power of a sum of two channels to a difference of the two channels. To illustrate, the frequency-specific metric value 310 may be determined using Equation 4:

$$\text{Metric}\ (f) = \frac{P_t(B(\theta, f)) + P_t(B(\pi, f))}{P_t(B(\theta, f)) - P_t(B(\pi, f))} \qquad \text{Equation 4}$$

where $P_t$ is the signal power of time sample t for a particular beam, B(θ,f) represents the components of beam 164 corresponding to frequency f, and B(π,f) represents the components of beam 166 corresponding to frequency f.

In a particular aspect, the frequency-specific metric values 310 are determined for each frequency that is less than a threshold frequency 308. As in FIG. 2, the metric indicates power for wind noise reduction, which corresponds to a gain that would be applied at the frequency to remove wind noise. Thus, higher values of the metric indicate that less of the signal is due to wind noise, and a lower value of the metric indicates that more of the signal is due to wind noise.

In a particular aspect, the frequency-specific metric values 310 are compared to one or more wind detection thresholds 314 at a conditional gain reduction block 312. In this aspect, a gain 316 applied to one or more channels of the audio data may be adjusted to reduce wind noise responsive to any of the frequency-specific metric values 310 satisfying (e.g., being less than or equal to) the wind detection threshold(s) 314. The wind detection threshold(s) 314 is a static or tunable value between 0 and 1.

In the example illustrated in FIG. 3, the gain(s) 316 that are adjusted by the conditional gain reduction block 312 include a θ-channel gain, a π-channel gain, or both. In other examples, when the spatial audio data 112 is based on beamforming, the conditional gain reduction block 312 is omitted, and the gain(s) 316 are not applied to any channel based on the frequency-specific metric values 310 satisfying the wind detection threshold(s) 314.

In a particular aspect, the frequency-specific metric values 310 are used to calculate band-specific metric values 338 at a band-specific metric calculation block 330. For example, the frequency-specific metric values 310 are grouped by frequency bands 332 and a weighted sum is used to calculate a band-specific metric value for each frequency band 332. In a particular implementation, the frequency bands 332 have a bandwidth of 500 Hz. In other implementations, the frequency bands 232 are larger (e.g., 1000 Hz) or smaller (e.g., 250 Hz). In still other implementations, different frequency bands 332 may have different bandwidths.

In a particular implementation, a band-specific metric value 338 for a particular frequency band may be calculated using Equation 2, above. The wind-reduction parameter 334 is a preconfigured or tunable value that affects how aggressively the device 300 reduced the wind noise, especially in lower frequency bands. For example, larger values of the wind-reduction parameter 334 will result in more reduction in low frequency wind noise and smaller values of the wind-reduction parameter 334 will result in less reduction in low frequency wind noise. As one example, a default value of 0.5 may be used for the wind-reduction parameter 334; however, the value of the wind-reduction parameter 334 may be tunable over a range of values, such as from 0.1 to 4 in a particular non-liming example.

In a particular aspect, the band-specific metric calculation block 330 may modify one or more of the frequency-specific metric values 310 before determining the band-specific metric values 338. For example, the band-specific metric calculation block 330 may compare each of the frequency-specific metric values 310 to an acceptance criterion 336. In this example, if a particular frequency-specific metric value 310 satisfies the acceptance criterion 336, the particular frequency-specific metric value 210 is determined to not represent wind noise. In this situation, the particular frequency-specific metric value 310 may be assigned a value of 1 to indicate that no wind noise is present. The acceptance criterion 336 is a pre-set or tunable value between 0 and 1. In a particular non-limiting example, the acceptance criterion 336 is between 0.6 and 0.9, and the acceptance criterion 336 is satisfied when a particular frequency-specific metric values 310 is greater than or equal to the acceptance criterion 336. To illustrate, if the acceptance criterion 336 has a value of 0.8, and the value of a particular frequency-specific metric value 310 is 0.82, the frequency-specific metric values 310 is assigned a frequency-specific metric value of 1 for purposes of determining the band-specific metric values 338.

The band-specific metric values 338 are shaped at the power shaping block 340. The shaping ensures that the power in lower frequency bands is greater than or equal to the power in higher frequency bands after modification of each frequency band based on the band-specific metric value 338 associated with the frequency band. For example, the power shaping block 340 may the logic such as.

$$\text{If Metric}_{band}(\text{Band}_k)*E(\text{Band}_k,(B(\theta)+B(\pi)))<\text{Metric}_{band}(\text{Band}_{k+1})*E(\text{Band}_{k+1},(B(\theta)+B(\pi)));$$

$$\text{then } \mathrm{Metric}_{band}(\mathrm{Band}_k)=\mathrm{Metric}_{band}(\mathrm{Band}_{k+1})*E(\mathrm{Band}_{k+1},(B(\theta)+B(\pi)))/E(\mathrm{Band}_k,(B(\theta)+B(\pi)))$$

where $\mathrm{Band}_k$ indicates a particular frequency band, $\mathrm{Bank}_{k+1}$ indicates the next higher frequency band, $E(\mathrm{Band}_k, (B(\theta)+B(\pi)))$ is the sum of the energy of the kth frequency band of the θ and π beams, and $E(\mathrm{Band}_{k+1}, W)$ is the sum of the energy of the k+1th frequency band of the θ and π beams, where the energy of each beam is determined based on the frequency-domain spatial audio data 304.

The power shaped band-specific metric values 338 are used as filter parameters 342 for a filter bank 344. The filter bank 344 modifies the frequency-domain spatial audio data 304 to generate filtered frequency-domain spatial audio data 346. For example, the filter bank 344 may determine the frequency-domain spatial audio data 346 for each frequency and channel using Equation 3, above.

In FIG. 3, the frequency-domain spatial audio data 346 is transformed from the frequency domain to the time domain using an IFFT 348 to generate one or more channels of the reduced-wind-noise audio data 116. For example, the IFFT 348 of FIG. 3 outputs a θ'-channel 318 which corresponds to the θ-channel 164 input to the FFT 302 with low-frequency wind noise components removed or reduced, and a π'-channel 324 which corresponds to the π-channel 166 input to the FFT 302 with low-frequency wind noise components removed or reduced. In the example illustrated in FIG. 3, the gain(s) 316 may be applied to the θ'-channel 318 via an amplifier 320 to generate an output θ'-channel 322, to the π'-channel 324 via an amplifier 326 to generate an output π-channel 328, or both, to further reduce wind-noise in the reduced-wind-noise audio data 116. In some implementations, the gain(s) 316 are gradually applied over multiple frames to limit sudden changes that can cause perceptible pops or other artifacts.

In some implementations, the reduced-wind-noise audio data 116 is provided to other components, such as the spatial audio converter 118 of FIG. 1, for further processing and to generate sound output (e.g., via the speaker(s) 126 of FIG. 1).

Figure 4:
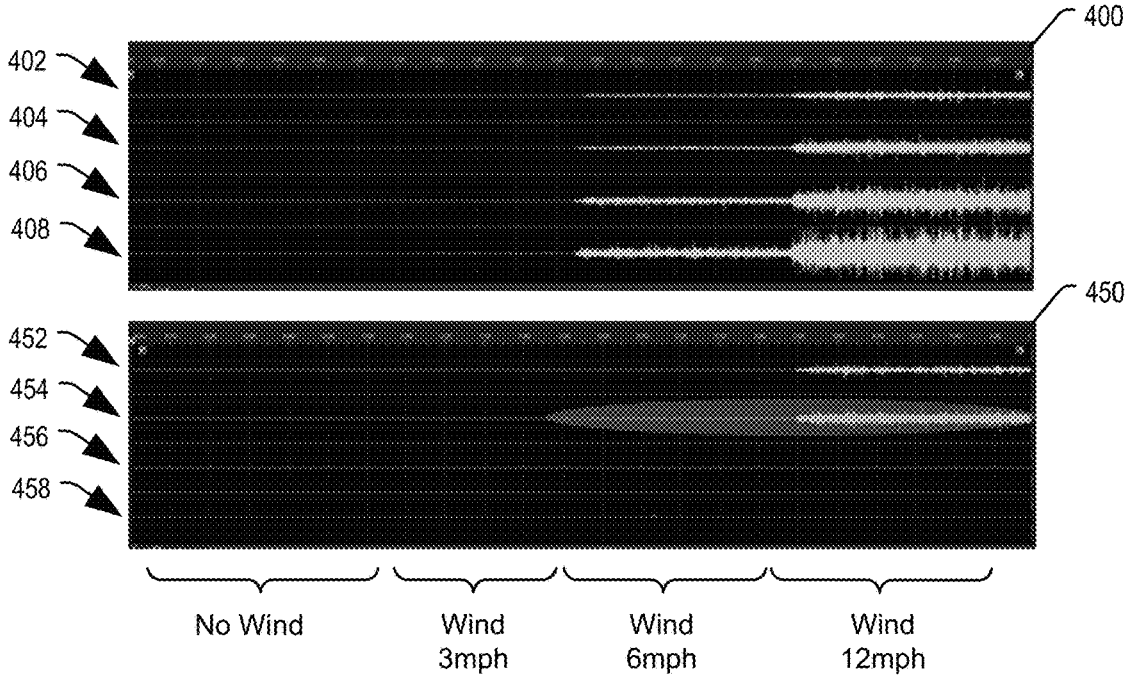
FIG. 4 is a set of graphs illustrating sound levels for several wind speeds without wind noise cancelation and with wind noise cancelation according to a particular example.

FIG. 4 is a set of graphs illustrating sound levels for several wind speeds without wind noise cancelation and with wind noise cancelation according to a particular example. In particular, a graph 400 of FIG. 4 illustrates wind noise in multiple ambisonics channels for various wind conditions when no wind-noise reduction is used. A graph 450 of FIG. 4 illustrates wind noise in the multiple ambisonics channels for the same wind conditions when the wind-noise reduction operations described herein are used.

In the graph 400, the ambisonics channels include a W-channel 402, a Y-channel 404, a Z-channel 406, and an X-channel 408, and the wind conditions include no wind, a 3 mile per hour (mph) wind, a 6 mph wind, and a 12 mph wind. The graph 400 shows detectable sound levels in all of the channels with a 6 mph wind and a significant increase in sound levels with a 12 mph wind. As illustrated in the graph 400, the sound levels in the Z-channel 406 and the X-channel 408 increase between the 6 mph wind and the 12 mph wind more than the sound levels for the W-channel 402 and the Y-channel 404 do.

The graph 450 shows ambisonics channels including a W-channel 452, a Y-channel 454, a Z-channel 456, and an X-channel 458 for the same wind conditions as illustrated in graph 400, but with wind-noise reduction applied. For the graph 450, the wind reduction includes both filtering (e.g., using the filter bank 244 of FIG. 2) and selectively applying gains to some of the ambisonics channels (e.g., via the amplifiers 220, 226 of FIG. 2). As illustrated in the graph 450, as the wind noise increases, the gain applied to the Z-channel 456 and the X-channel 458 is decreased (or zeroed out) such that for the 6 mph wind and the 12 mph wind the Z-channel 456 and the X-channel 458 are turned off, which significantly reduces sound levels due to wind noise. Additionally, the W-channel 452 and the Y-channel 454 are filtered to further reduce wind noise.

Figure 5:
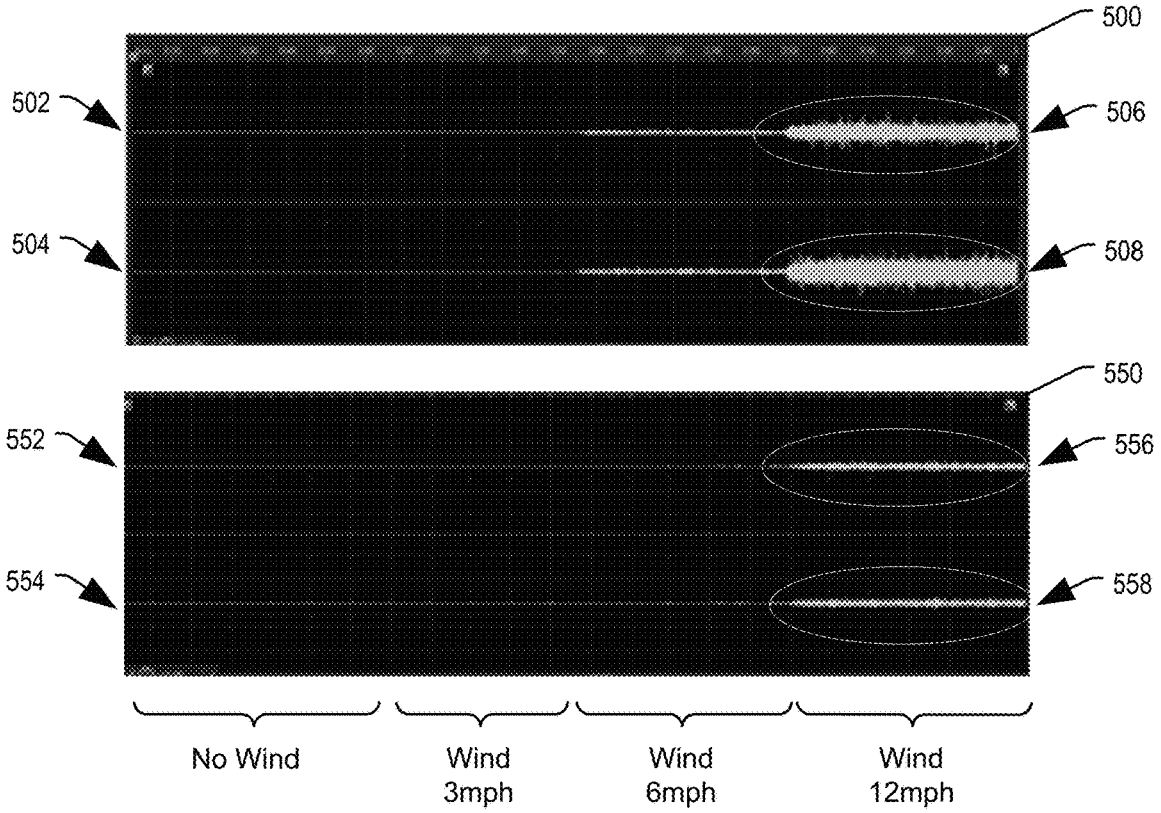
FIG. 5 is a set of graphs illustrating sound levels for several wind speeds without wind noise cancelation and with wind noise cancelation according to another particular example.

FIG. 5 is a set of graphs illustrating sound levels for several wind speeds without wind noise cancelation and with wind noise cancelation according to a particular example. In particular, a graph 500 of FIG. 5 illustrates wind noise in multiple beams for various wind conditions when no wind-noise reduction is used. A graph 550 of FIG. 5 illustrates wind noise in the multiple beams for the same wind conditions when the wind-noise reduction operations described herein are used.

In the graph 500, a first channel 502 corresponds to a first beam and a second channel 504 corresponds to a second beam. To generate the graph 500, the two beams were set 180 degrees apart from one another. To illustrate, the angle 168 of FIG. 1 between the beams was 180 degrees. The graph 500 shows detectable sound levels in both channels with a 6 mph wind and a significant increase in sound levels with a 12 mph wind.

The graph 550 shows a first channel 552 corresponding to the first channel 502 with wind noise reduction applied, and a second channel 554 corresponding to the second channel 504 with wind noise reduction applied. For the graph 450, the wind reduction includes filtering (e.g., using the filter bank 344 of FIG. 3) the channels to remove low-frequency wind noise. Comparison of regions 506 and 508 of the graph 500 with corresponding regions 556 and 558 of the graph 550 shows that the filtering significantly reduces sound levels due to wind noise.

Figure 6:
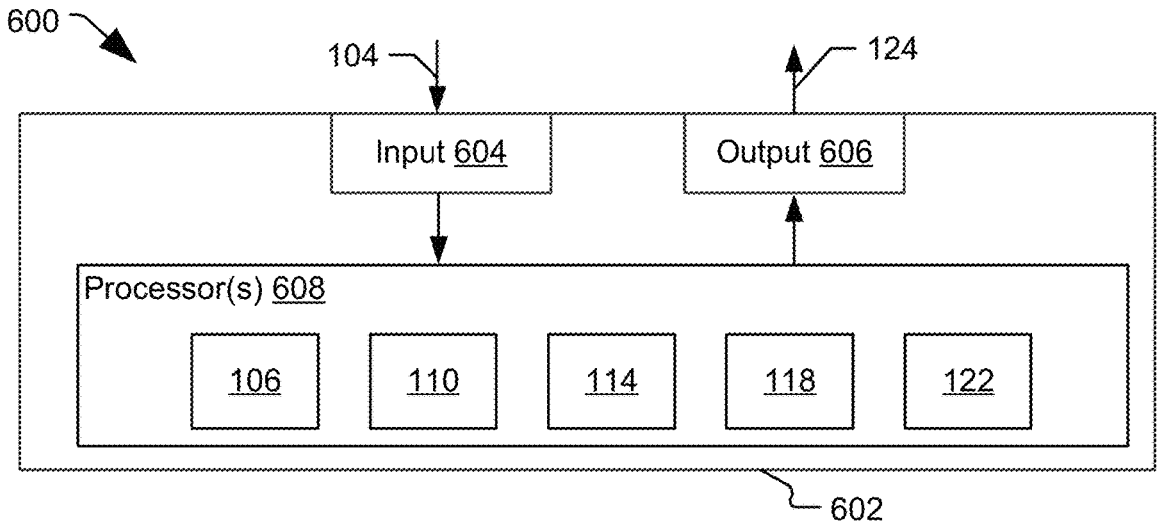
FIG. 6 illustrates an example of an integrated circuit operable to perform aspects of wind noise detection and reduction in accordance with some examples of the present disclosure.
Figure 9:
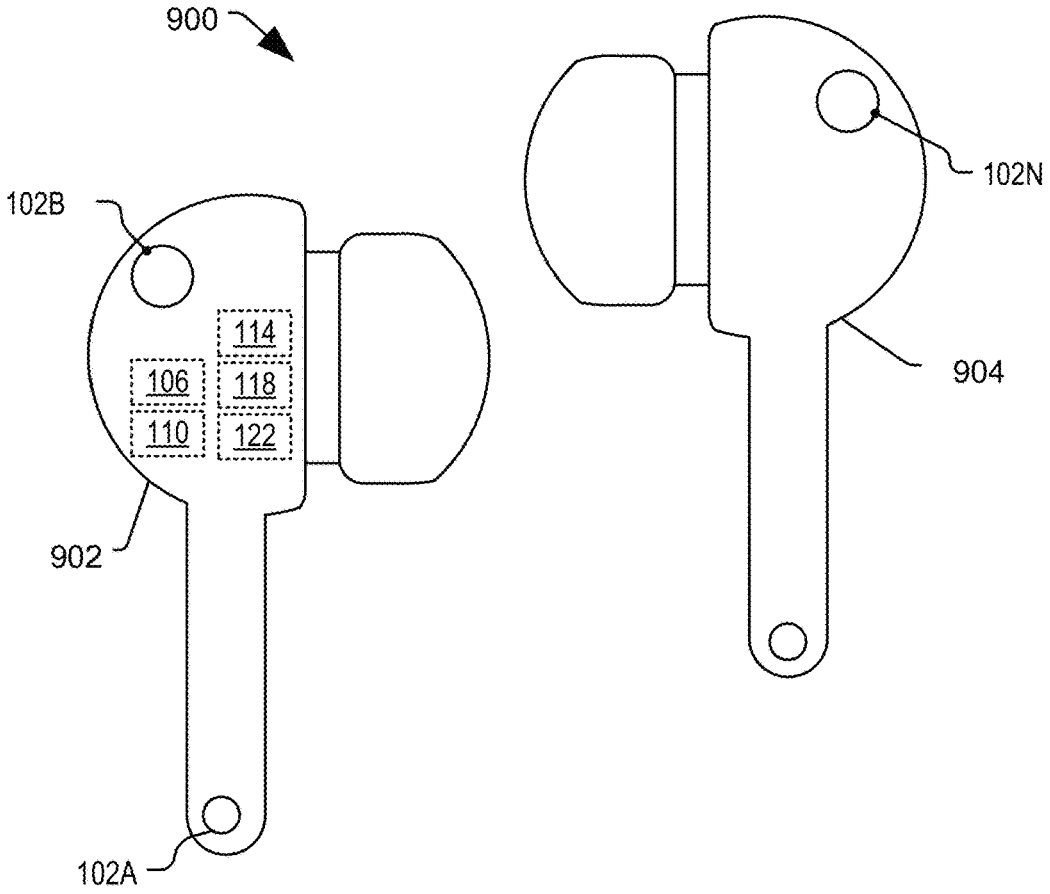
FIG. 9 illustrates earbud that incorporates aspects of the device of FIG. 1.
Figure 10:
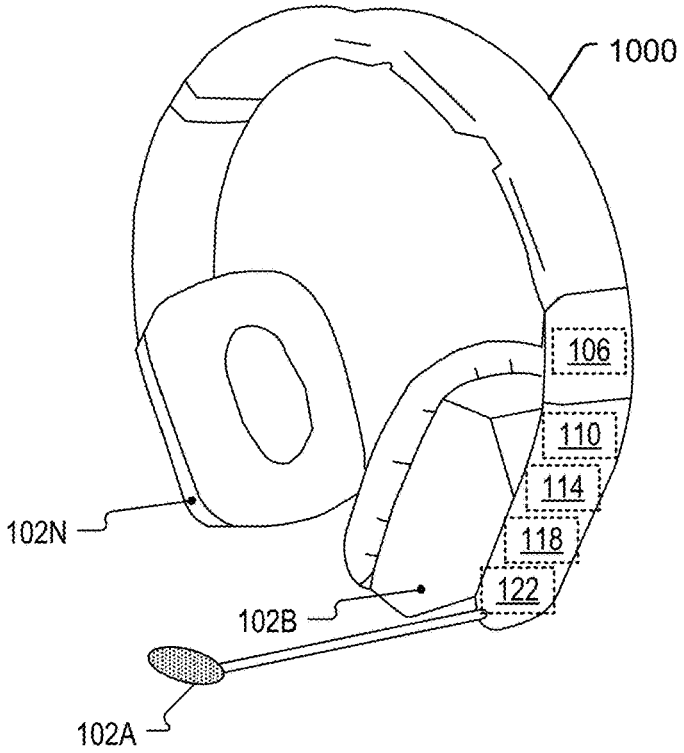
FIG. 10 illustrates a headset that incorporates aspects of the device of FIG. 1.
Figure 11:
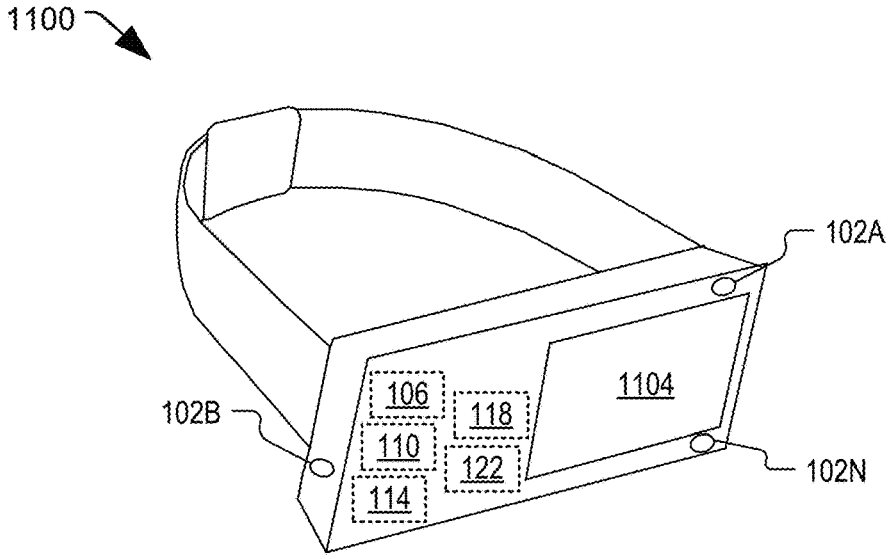
FIG. 11 illustrates a wearable device that incorporates aspects of the device of FIG. 1.
Figure 12:
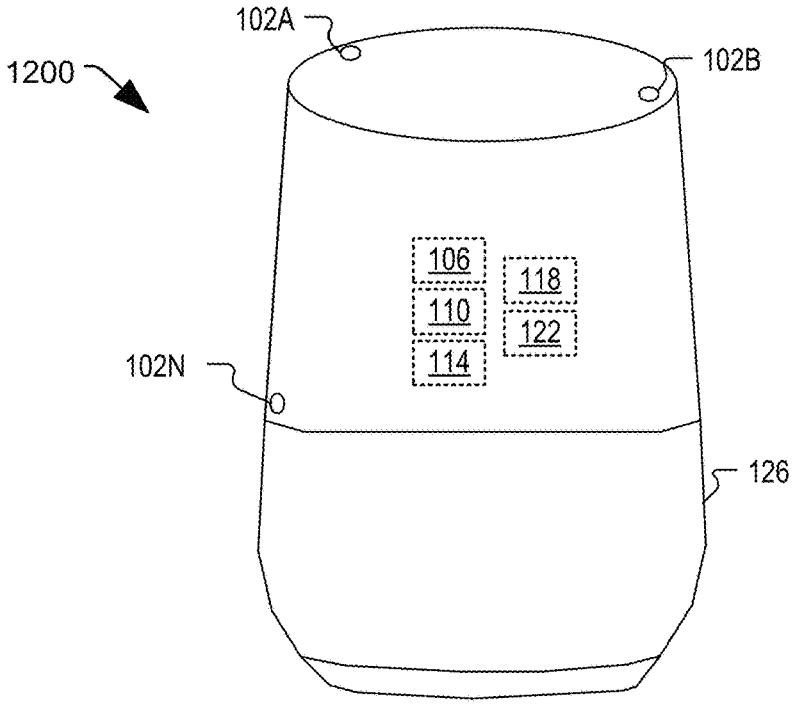
FIG. 12 illustrates a voice-controlled speaker system that incorporates aspects of the device of FIG. 1.
Figure 13:
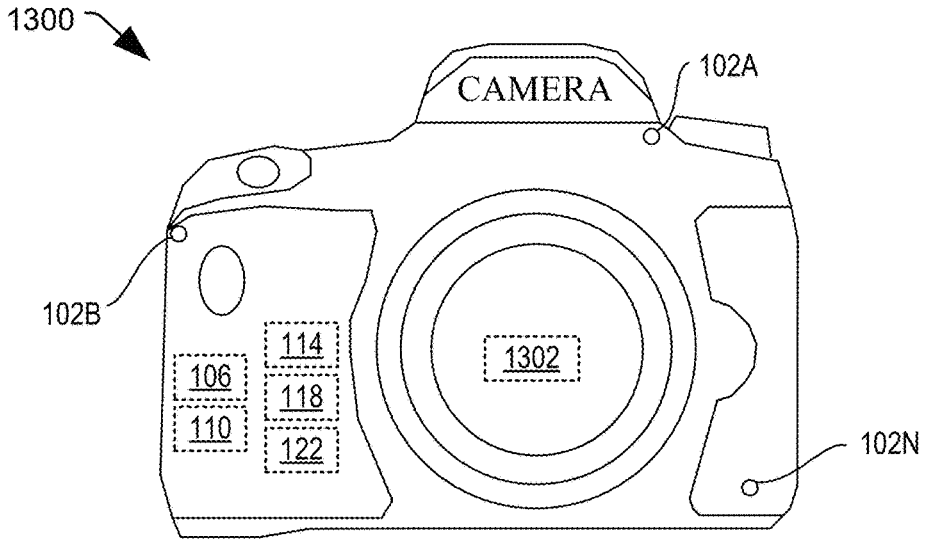
FIG. 13 illustrates a camera that incorporates aspects of the device of FIG. 1.
Figure 14:
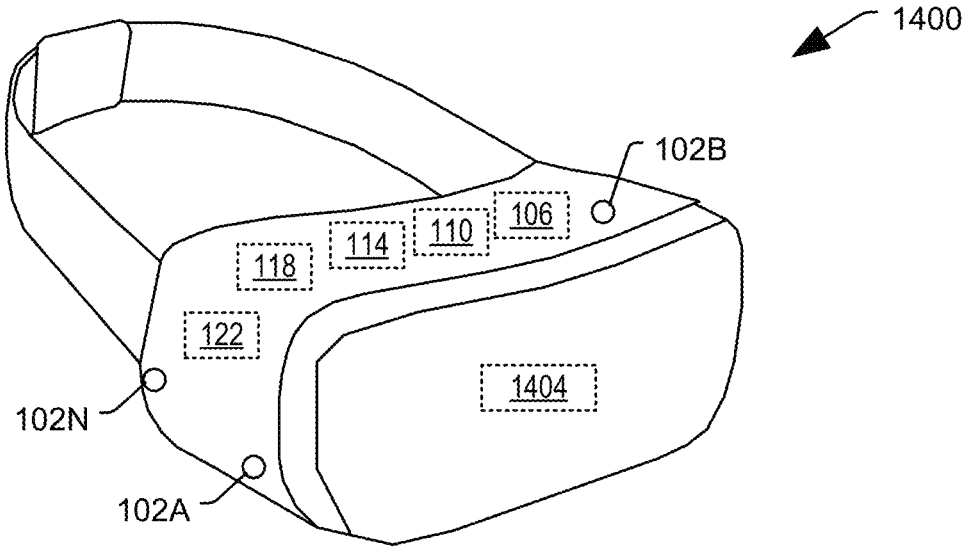
FIG. 14 illustrates a headset that incorporates aspects of the device of FIG. 1.
Figure 15:
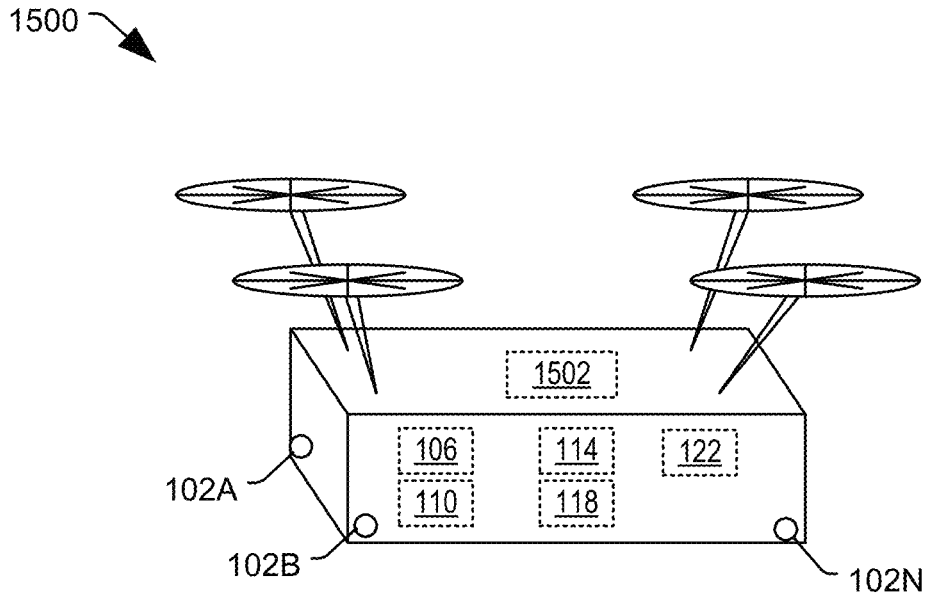
FIG. 15 illustrates an aerial device that incorporates aspects of the device of FIG. 1.
Figure 16:
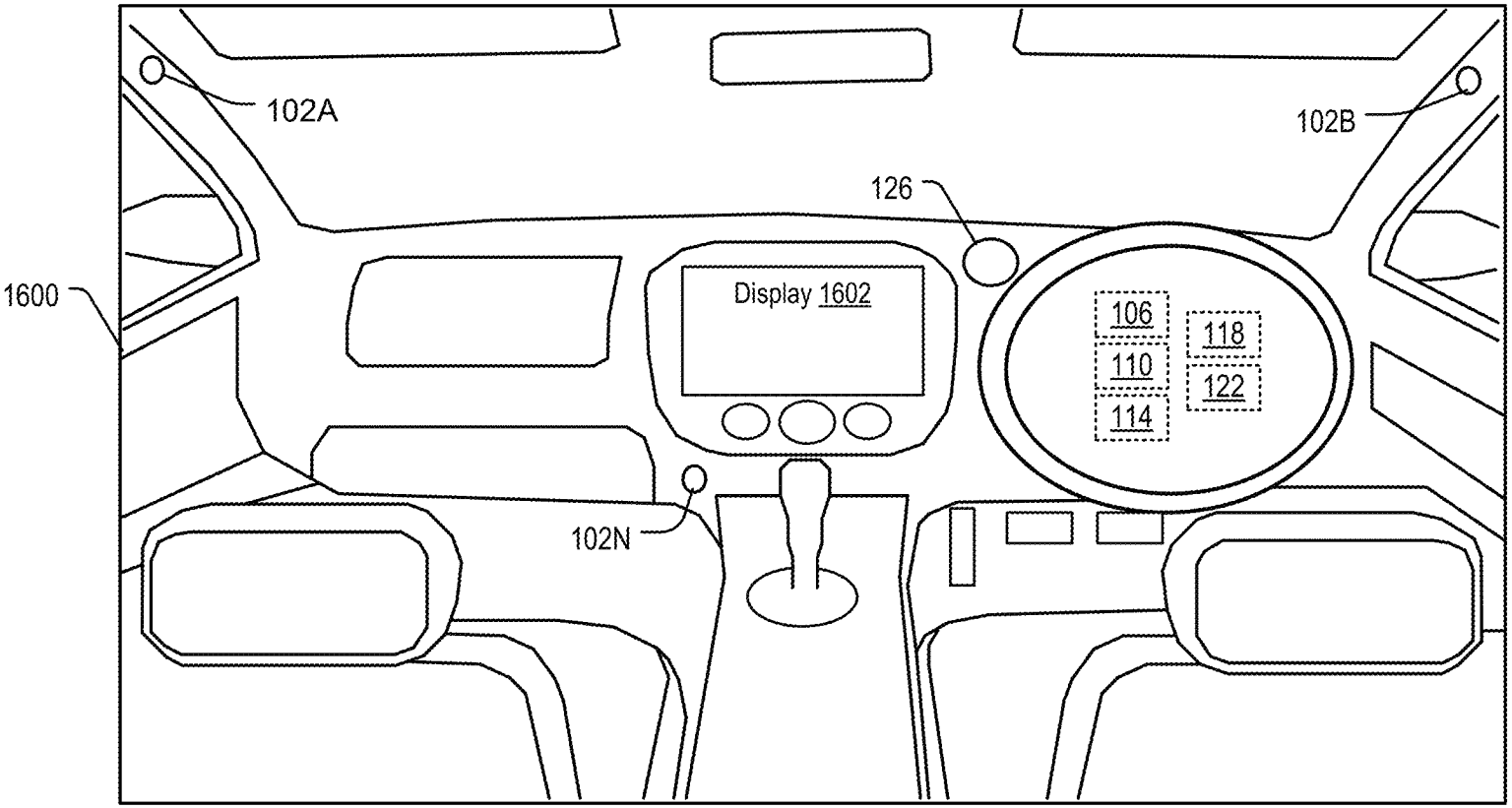
FIG. 16 illustrates a vehicle that incorporates aspects of the device of FIG. 1.

FIG. 6 depicts an implementation 600 of the device 100 as an integrated circuit 602 that includes one or more processors 608. The integrated circuit 602 also includes an input 604, such as one or more bus interfaces, to enable the audio data 104 or other signals to be received from the microphones 102 for processing. The integrated circuit 602 also includes an output 606, such as a bus interface, to enable sending of an output signal, such as the reduced-wind-noise audio data 124. In FIG. 6, the processor(s) 608 include the wind turbulence noise reduction engine 106, the spatial audio converter 110, the spatial-audio wind noise reduction processor 114, the spatial audio converter 118, and the ambient noise suppressor 122. In other implementations, one or more of the wind turbulence noise reduction engine 106, the spatial audio converter 110, the spatial audio converter 118, and the ambient noise suppressor 122 is omitted. The integrated circuit 602 enables implementation of wind noise reduction in a system that includes the microphones 102, such as a mobile phone or tablet as depicted in FIG. 8, earbuds as depicted in FIG. 9, a headset as depicted in FIG. 10, a wearable electronic device as depicted in FIG. 11, a voice-controlled speaker system as depicted in FIG. 12, a camera as depicted in FIG. 13, a virtual reality headset, mixed reality headset, or an augmented reality headset as depicted in FIG. 14, or a vehicle as depicted in FIG. 15 or FIG. 16.

Figure 7:
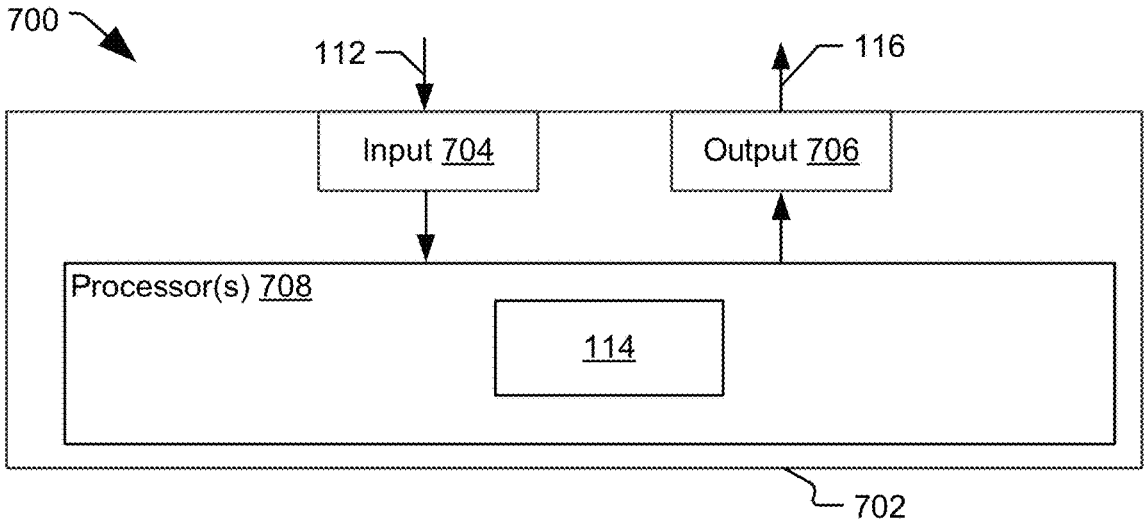
FIG. 7 illustrates another example of an integrated circuit operable to perform aspects of wind noise detection and reduction in accordance with some examples of the present disclosure.

FIG. 7 depicts an implementation 700 of the device 200 or the device 300 as an integrated circuit 702 that includes one or more processors 708. The integrated circuit 702 also includes an input 704, such as one or more bus interfaces, to enable the spatial audio data 112 or other signals to be received for processing. The integrated circuit 702 also includes an output 706, such as a bus interface, to enable sending of an output signal, such as the reduced-wind-noise audio data 116. In FIG. 7, the processor(s) 708 include the spatial-audio wind noise reduction processor 114. In other implementations, the processor(s) 708 also include one or more of the wind turbulence noise reduction engine 106, the spatial audio converter 110, the spatial audio converter 118, or the ambient noise suppressor 122. The integrated circuit 602 enables implementation of wind noise reduction in spatial audio by a system that processes spatial audio data, such as a mobile phone or tablet as depicted in FIG. 8, earbuds as depicted in FIG. 9, a headset as depicted in FIG. 10, a wearable electronic device as depicted in FIG. 11, a voice-controlled speaker system as depicted in FIG. 12, a camera as depicted in FIG. 13, a virtual reality headset, mixed reality headset, or an augmented reality headset as depicted in FIG. 14, or a vehicle as depicted in FIG. 15 or FIG. 16.

Figure 8:
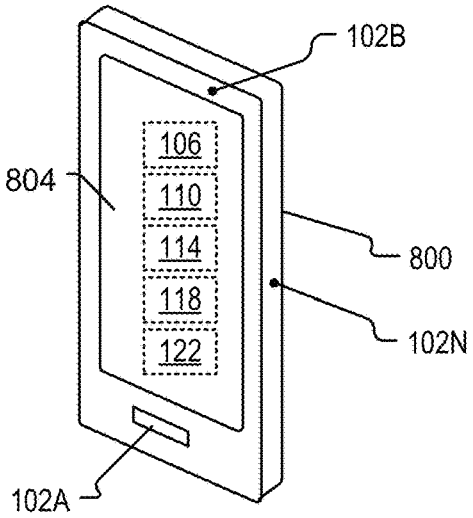
FIG. 8 illustrates a mobile device that incorporates aspects of the device of FIG. 1.

FIG. 8 illustrates a mobile device 800 that incorporates aspects of the device 100 of FIG. 1. In FIG. 8, the mobile device 800 includes or is coupled to the device 100 of FIG. 1, the integrated circuit 602 of FIG. 6, the integrated circuit 702 of FIG. 7, or a combination thereof. For example, in FIG. 8, the mobile device 800 includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user. The mobile device 800 includes a phone or tablet, as illustrative, non-limiting examples. The mobile device 800 includes a display screen 804 and one or more sensors, such as the microphone(s) 102A, 102B, and 102N of FIG. 1.

During operation, the mobile device 800 may perform particular actions in response to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

FIG. 9 illustrates earbuds 900 that incorporate aspects of the device 100 of FIG. 1. In FIG. 9, the earbuds 900 include or are coupled to the device 100 of FIG. 1. For example, in FIG. 9, a first earbud 902 of the earbuds 900 includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user. In some implementations, a second earbud 904 also includes the wind turbulence noise reduction engine 106, the spatial audio converter 110, the spatial-audio wind noise reduction processor 114, the spatial audio converter 118, and the ambient noise suppressor 122.

The earbuds 900 include the microphones 102A, 102B, and 102N, at least one of which is positioned to primarily capture speech of a user. The earbuds 900 may also include one or more additional microphones positioned to primarily capture environmental sounds (e.g., for noise canceling operations).

In a particular aspect, during operation, the earbuds 900 may perform particular actions in response to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

FIG. 10 illustrates a headset 1000 that incorporates aspects of the device 100 of FIG. 1. For example, in FIG. 10, the headset 1000 includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user. The headset 1000 includes the microphone 102A positioned to primarily capture speech of a user, and one or more additional microphone (e.g., microphones 102B and 102N) positioned to primarily capture environmental sounds (e.g., for noise canceling operations).

In a particular aspect, during operation, the headset 1000 may perform particular actions in response to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

FIG. 11 depicts an example of the device 100 integrated into a wearable electronic device 1100, illustrated as a "smart watch," that includes a display 1104 and sensor(s), such as the microphones 102A, 102B, and 102N. In FIG. 11, the wearable electronic device 1100 includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user.

In a particular aspect, during operation, the wearable electronic device 1100 may perform particular actions in response to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

FIG. 12 is an illustrative example of a voice-controlled speaker system 1200. The voice-controlled speaker system 1200 can have wireless network connectivity and is configured to execute an assistant operation. In FIG. 12, aspects of the device 100 of FIG. 1 are included in the voice-controlled speaker system 1200. For example, in FIG. 12, the voice-controlled speaker system 1200 includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user. The voice-controlled speaker system 1200 also includes the speaker(s) 126 and sensors. The sensors can include the microphone(s) 102 of FIG. 1 to receive voice input or other audio input.

In a particular aspect, during operation, the voice-controlled speaker system 1200 may perform particular actions in response to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

FIG. 13 illustrates a camera 1300 that incorporates aspects of the device 100 of FIG. 1. In FIG. 13, the device 100 is incorporated in or coupled to the camera 1300. For example, in FIG. 13, the camera 1300 includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user. The camera 1300 also includes an image sensor 1302 and one or more other sensors, such as the microphone(s) 102 of FIG. 1.

In a particular aspect, during operation, the camera 1300 may perform particular actions in response to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

FIG. 14 depicts an example of the device 100 coupled to or integrated within a headset 1400, such as a virtual reality headset, an augmented reality headset, a mixed reality headset, an extended reality headset, a head-mounted display, or a combination thereof. A visual interface device, such as a display 1404, is positioned in front of the user's eyes to enable display of augmented reality or virtual reality images or scenes to the user while the headset 1400 is worn. In FIG. 14, the headset 1400 also includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user. The headset 1402 also includes one or more sensor(s), such as the microphone(s) 102 of FIG. 1, cameras, other sensors, or a combination thereof.

In a particular aspect, during operation, the headset 1400 may perform particular actions in response to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

FIG. 15 illustrates a vehicle (e.g., an aerial device 1500) that incorporates aspects of the device 100 of FIG. 1. In FIG. 15, the aerial device 1500 includes or is coupled to the device 100 of FIG. 1. For example, in FIG. 15, the aerial device 1500 includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user. The aerial device 1500 is a manned, unmanned, or remotely piloted aerial device (e.g., a package delivery drone). The aerial device 1500 includes a control system 1502 and one or more sensors, such as the microphone(s) 102 of FIG. 1.

The control system 1502 controls various operations of the aerial device 1500, such as cargo release, sensor activation, take-off, navigation, landing, or combinations thereof. For example, the control system 1502 may control flight of the aerial device 1500 between specified points and deployment of cargo at a particular location. In a particular aspect, the control system 1502 performs one or more action responsive to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

FIG. 16 is an illustrative example of a vehicle 1600 that incorporates aspects of the device 100 of FIG. 1. According to one implementation, the vehicle 1600 is a self-driving car. According to other implementations, the vehicle 1600 is a car, a truck, a motorcycle, an aircraft, a water vehicle, etc. In FIG. 16, the vehicle 1600 includes a screen 1602, sensor(s) (e.g., the microphones 102 of FIG. 1), and aspects of the device 100. For example, in FIG. 16, the vehicle 1600 includes the wind turbulence noise reduction engine 106, the spatial audio converter 110, the spatial-audio wind noise reduction processor 114, the spatial audio converter 118, and the ambient noise suppressor 122, each of which is illustrated in dotted lines to indicate that they are not generally visible to a user. The device 100 can be integrated into the vehicle 1600 or coupled to the vehicle 1600.

In a particular implementations, the sensor(s) include also include vehicle occupancy sensors, eye tracking sensor, or external environment sensors (e.g., lidar sensors or cameras). In a particular aspect, sensor data from one or more sensors indicates a location of the user. For example, the sensors are associated with various locations within the vehicle 1600.

In a particular aspect, the vehicle 1600 performs one or more action responsive to detecting wind noise. For example, the actions can include filtering one or more channels of spatial audio data to reduce wind noise in captured audio. As another example, the actions can include adjusting a gain applied to one or more channels of spatial audio data to reduce wind noise in captured audio.

Figure 17:
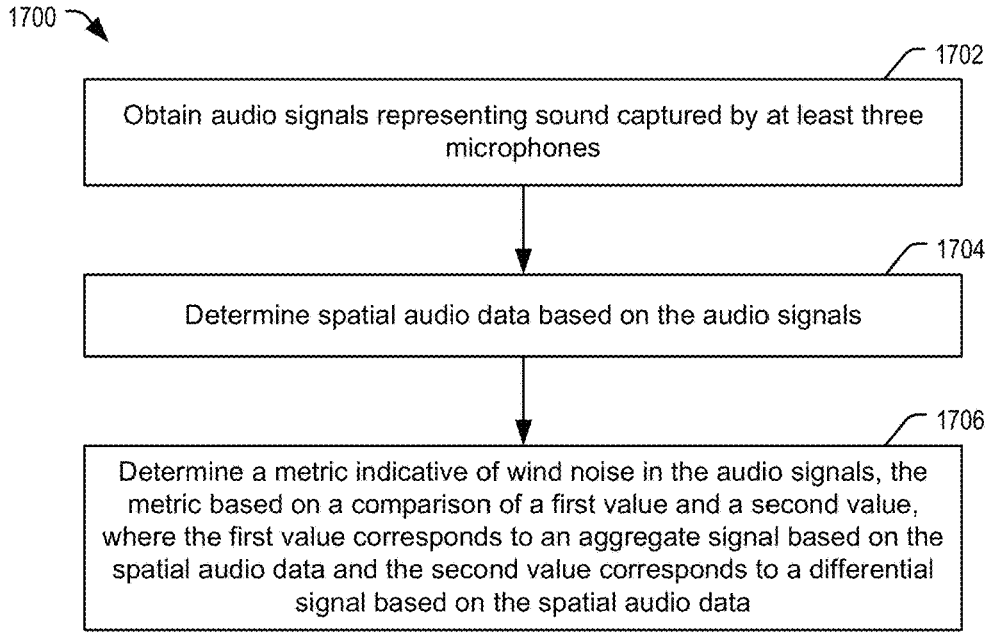
FIG. 17 is a flow chart illustrating aspects of an example of a method of detecting wind noise in spatial audio data using the device of FIG. 1.

FIG. 17 is a flow chart illustrating aspects of an example of a method 1700 of detecting wind noise in spatial audio data. The method 1700 can be initiated, controlled, or performed by the device 100 of FIG. 1, by the device 200 of FIG. 2, by the device 300 of FIG. 3, or a combination thereof. In a particular aspect, one or more processor(s) can execute instructions from a memory to perform the method 1700.

The method 1700 includes, at block 1702, obtaining audio signals representing sound captured by at least three microphones. For example, the device 100 of FIG. 1 may obtain the audio data 104 from the microphones 102. In another example, the audio data 104 may be read from a memory or received from a remote computing device (e.g., via a network connection or a peer-to-peer ad hoc connection).

The method 1700 includes, at block 1704, determining spatial audio data based on the audio signals. For example, the spatial audio converter 110 may generate the spatial audio data 112 based on the audio data 104 using ambisonics processing or beamforming.

The method 1700 includes, at block 1706, determining a metric indicative of wind noise in the audio signals. The metric is based on a comparison of a first value and a second value, where the first value corresponds to an aggregate signal based on the spatial audio data and the second value corresponds to a differential signal based on the spatial audio data. For example, when the spatial audio data 112 includes ambisonics coefficients, the metric may be determined as a ratio of signal power of the W-channel for a particular frequency and time frame to a signal power of one of the differential channels (e.g., the X-, Y-, or Z-channel) for the particular frequency and time frame. As another example, when the spatial audio data includes two or more beams, the metric may be determined as a ratio of a sum of the signal power of two beams for a particular frequency and time frame and a difference of the signal power of the two beams for the particular frequency and time frame.

Figure 18:
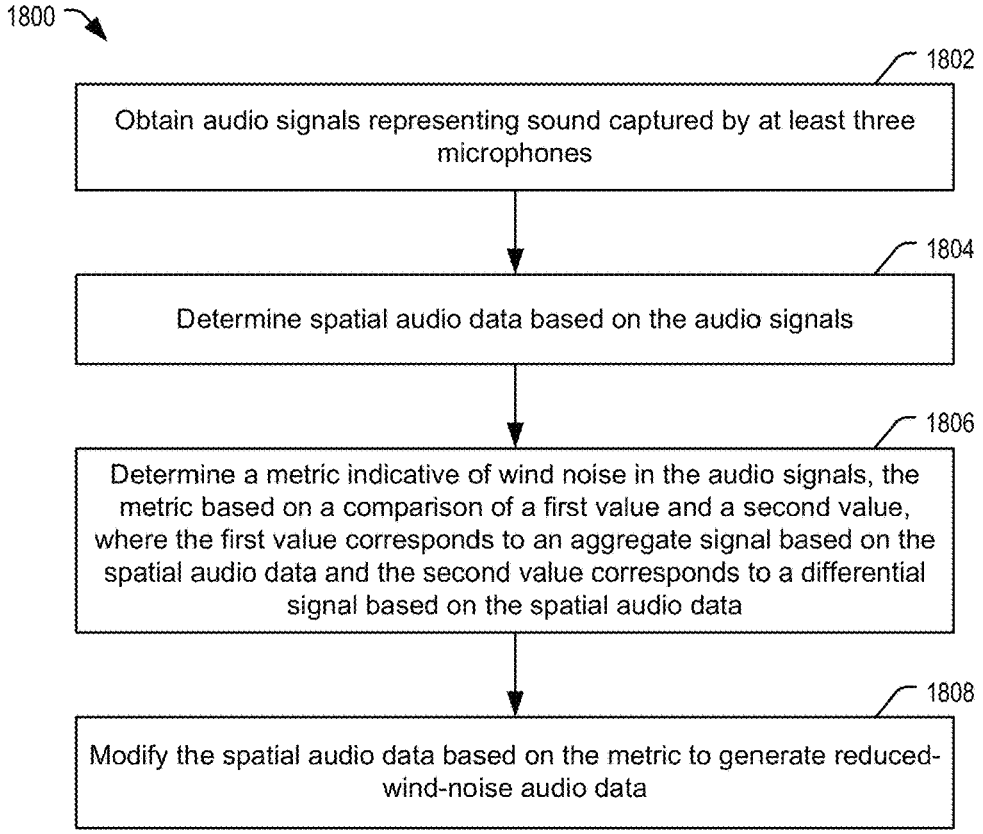
FIG. 18 is a flow chart illustrating aspects of an example of a method of detecting and reducing wind noise in spatial audio data using the device of FIG. 1.

FIG. 18 is a flow chart illustrating aspects of an example of a method 1800 of detecting and reducing wind noise in spatial audio data. The method 1800 can be initiated, controlled, or performed by the device 100 of FIG. 1, by the device 200 of FIG. 2, by the device 300 of FIG. 3, or a combination thereof. In a particular aspect, one or more processor(s) can execute instructions from a memory to perform the method 1800.

The method 1800 includes, at block 1802, obtaining audio signals representing sound captured by at least three microphones. For example, the device 100 of FIG. 1 may obtain the audio data 104 from the microphones 102. In another example, the audio data 104 may be read from a memory or received from a remote computing device (e.g., via a network connection or a peer-to-peer ad hoc connection).

The method 1800 includes, at block 1804, determining spatial audio data based on the audio signal. For example, the spatial audio converter 110 may generate the spatial audio data 112 based on the audio data 104 using ambisonics processing or beamforming.

The method 1800 includes, at block 1806, determining a metric indicative of wind noise in the audio signals. The metric is based on a comparison of a first value and a second value, where the first value corresponds to an aggregate signal based on the spatial audio data and the second value corresponds to a differential signal based on the spatial audio data. The metric is based on a comparison of a first value and a second value, where the first value corresponds to an aggregate signal based on the spatial audio data and the second value corresponds to a differential signal based on the spatial audio data. For example, when the spatial audio data 112 includes ambisonics coefficients, the metric may be determined as a ratio of signal power of the W-channel for a particular frequency and time frame to a signal power of one of the differential channels (e.g., the X-, Y-, or Z-channel) for the particular frequency and time frame. As another example, when the spatial audio data includes two or more beams, the metric may be determined as a ratio of a sum of the signal power of two beams for a particular frequency and time frame and a difference of the signal power of the two beams for the particular frequency and time frame.

The method 1800 includes, at block 1808, modifying the spatial audio data based on the metric to generate reduced-wind-noise audio data. For example, filter parameters (such as the filter parameters 242 of FIG. 2 or filter parameters 342 of FIG. 3) may be used to filter the spatial audio data (e.g., in a frequency domain) to generate the reduced-wind-noise audio data 116. As another example, a gain applied to one or more channels of the spatial audio data (e.g., the gain(s) 216 or the gain(s) 316) may be changed (e.g., reduced) to generate the reduced-wind-noise audio data 116.

Figure 19:
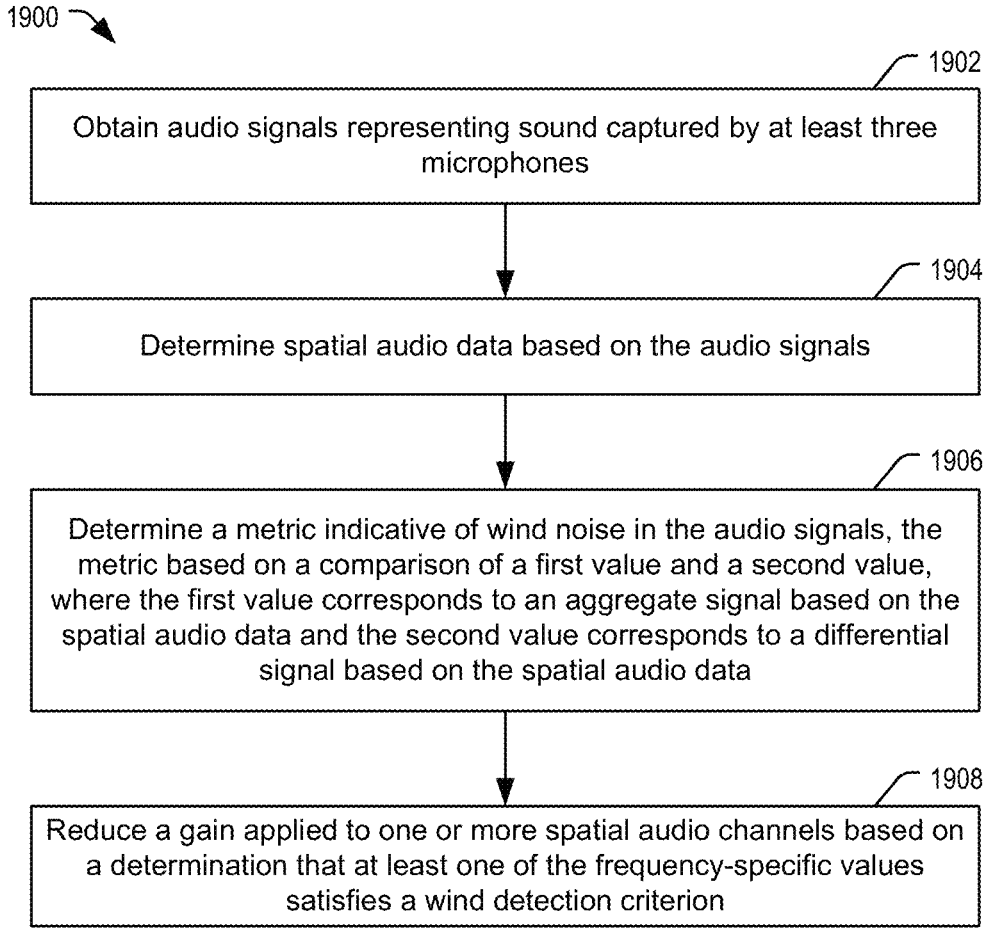
FIG. 19 is a flow chart illustrating aspects of an example of a method of detecting and reducing wind noise in spatial audio data using the device of FIG. 1.

FIG. 19 is a flow chart illustrating aspects of an example of a method 1900 of detecting and reducing wind noise in spatial audio data. The method 1900 can be initiated, controlled, or performed by the device 100 of FIG. 1, by the device 200 of FIG. 2, by the device 300 of FIG. 3, or a combination thereof. In a particular aspect, one or more processor(s) can execute instructions from a memory to perform the method 1900.

The method 1900 includes, at block 1902, obtaining audio signals representing sound captured by at least three microphones. For example, the device 100 of FIG. 1 may obtain the audio data 104 from the microphones 102. In another example, the audio data 104 may be read from a memory or received from a remote computing device (e.g., via a network connection or a peer-to-peer ad hoc connection).

The method 1900 includes, at block 1904, determining spatial audio data based on the audio signal. For example, the spatial audio converter 110 may generate the spatial audio data 112 based on the audio data 104 using ambisonics processing or beamforming.

The method 1900 includes, at block 1906, determining a metric indicative of wind noise in the audio signals. The metric is based on a comparison of a first value and a second value, where the first value corresponds to an aggregate signal based on the spatial audio data and the second value corresponds to a differential signal based on the spatial audio data. The metric is based on a comparison of a first value and a second value, where the first value corresponds to an aggregate signal based on the spatial audio data and the second value corresponds to a differential signal based on the spatial audio data. For example, when the spatial audio data 112 includes ambisonics coefficients, the metric may be determined as a ratio of signal power of the W-channel for a particular frequency and time frame to a signal power of one of the differential channels (e.g., the X-, Y-, or Z-channel) for the particular frequency and time frame. As another example, when the spatial audio data includes two or more beams, the metric may be determined as a ratio of a sum of the signal power of two beams for a particular frequency and time frame and a difference of the signal power of the two beams for the particular frequency and time frame.

The method 1900 includes, at block 1908, reducing a gain applied to one or more spatial audio channels based on a determination that at least one of the frequency-specific values satisfies a wind detection criterion. For example, the conditional gain reduction block 212 of FIG. 2 can output the gain(s) 216 which are applied to the X-channel, the Z-channel, or both, of a set of ambisonics data to wind noise. As another example, the conditional gain reduction block 312 of FIG. 3 can output the gain(s) 316 which are applied to one or more beams of the spatial audio data.

Figure 20:
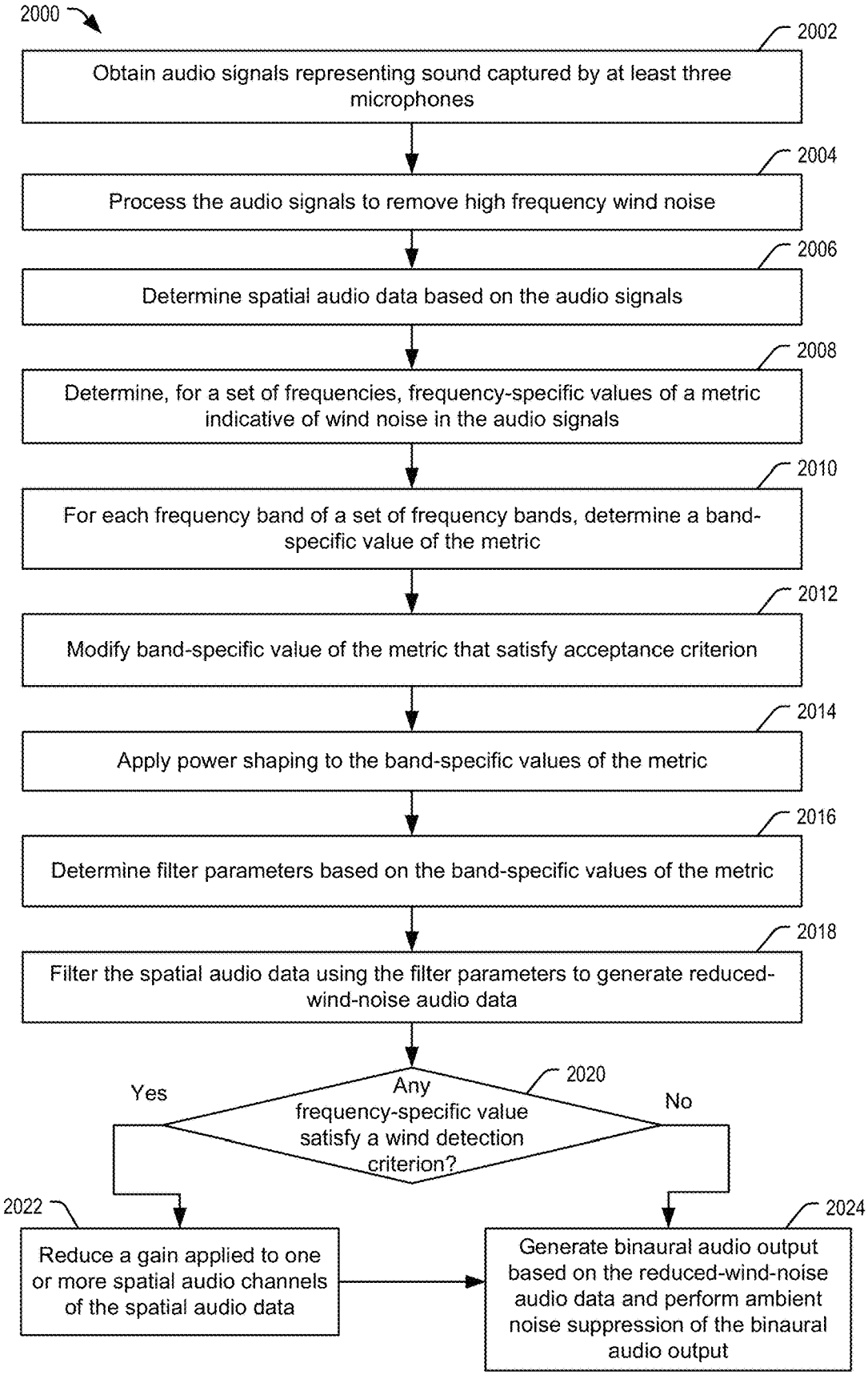
FIG. 20 is a flow chart illustrating aspects of an example of a method of detecting and reducing wind noise in spatial audio data using the device of FIG. 1.

FIG. 20 is a flow chart illustrating aspects of an example of a method 2000 of detecting and reducing wind noise in spatial audio data. The method 2000 can be initiated, controlled, or performed by the device 100 of FIG. 1, by the device 200 of FIG. 2, by the device 300 of FIG. 3, or a combination thereof. In a particular aspect, one or more processor(s) can execute instructions from a memory to perform the method 2000.

The method 2000 includes, at block 2002, obtaining audio signals representing sound captured by at least three microphones. For example, the device 100 of FIG. 1 may obtain the audio data 104 from the microphones 102. In another example, the audio data 104 may be read from a memory or received from a remote computing device (e.g., via a network connection or a peer-to-peer ad hoc connection).

The method 2000 includes, at block 2004, processing the audio signals to remove high frequency wind noise. For example, the wind turbulence noise reduction engine 106 of FIG. 1 processes the audio data 104 to remove or reduce high-frequency wind noise associated with wind turbulence.

The method 2000 includes, at block 2006, determining spatial audio data based on the audio signal. For example, the spatial audio converter 110 of FIG. 1 may generate the spatial audio data 112 based on the audio data 104 using ambisonics processing or beamforming.

The method 2000 includes, at block 2008, determining, for a set of frequencies, frequency-specific values of a metric indicative of wind noise in the audio signals. For example, the frequency-specific metric values 210 may be calculated by the metric calculation block 206 of FIG. 2, or the frequency-specific metric values 310 may be calculated by the metric calculation block 306 of FIG. 3.

The method 2000 includes, at block 2010, for each frequency band of a set of frequency bands, determining a band-specific value of the metric. For example, the band-specific metric values 238 may be calculated by the band-specific metric calculation block 230 of FIG. 2, or the band-specific metric values 338 may be calculated by the band-specific metric calculation block 330 of FIG. 3.

The method 2000 includes, at block 2012, modifying band-specific value of the metric that satisfy acceptance criterion. For example, the band-specific metric calculation block 230 of FIG. 2 may compare each band-specific metric value 238 to the acceptance criterion 236 and modify band-specific metric values 238 that satisfy the acceptance criterion 236. As another example, the band-specific metric calculation block 330 of FIG. 3 may compare each band-specific metric value 338 to the acceptance criterion 336 and modify band-specific metric values 338 that satisfy the acceptance criterion 336.

The method 2000 includes, at block 2014, applying power shaping to the band-specific values of the metric. For example, the power shaping block 240 of FIG. 2 may apply power shaping based on the band-specific metric values 238 and the frequency-domain spatial audio data 204. In another example, the power shaping block 340 of FIG. 3 may apply power shaping based on the band-specific metric values 338 and the frequency-domain spatial audio data 304.

The method 2000 includes, at block 2016, determining filter parameters based on the band-specific values of the metric. For example, the filter parameters 242 of FIG. 2 may be generated based on the power shifted band-specific metric values 238. As another example, the filter parameters 342 of FIG. 3 may be generated based on the power shifted band-specific metric values 338.

The method 2000 includes, at block 2018, filtering the spatial audio data using the filter parameters to generate reduced-wind-noise audio data. For example, the filter bank 244 of FIG. 2 applies the filter parameters 242 to modify one or more channels of the spatial audio data to reduce wind noise. As another example, the filter bank 344 of FIG. 3 applies the filter parameters 342 to modify one or more channels of the spatial audio data to reduce wind noise.

The method 2000 includes, at block 2020, determining whether any frequency-specific values of the metric satisfies a wind detection criterion. For example, the conditional gain reduction block 212 may compare each of the frequency-specific metric values 210 to the wind detection threshold 214, or the conditional gain reduction block 312 may compare each of the frequency-specific metric values 310 to the wind detection threshold 314.

The method 2000 includes, at block 2022, based on a determination that at least one of the frequency-specific values of the metric satisfies a wind detection criterion, reducing a gain applied to one or more spatial audio channels. For example, the amplifiers 220, 226 may apply the gain(s) 216 to one or more channels of the spatial audio data to reduce wind noise. As another example, the amplifiers 320, 326 may apply the gain(s) 316 to one or more channels of the spatial audio data to reduce wind noise.

The method 2000 includes, at block 2024, generating binaural audio output based on the reduced-wind-noise audio data and performing ambient noise suppression of the binaural audio output. In the implementation illustrated in FIG. 20, the binaural audio output is generated and the ambient noise suppression is performed after the reduced gain is applied, at block 2022, or based on a determination that none of the frequency-specific values of the metric satisfies a wind detection criterion, at block 2020. In particular examples, the spatial audio converter 118 of FIG. 1 may generate binaural audio output based on the reduced-wind-noise audio data and the ambient noise suppressor 122 may perform ambient noise suppression of the binaural audio output.

Referring to FIG. 21, a block diagram of a particular illustrative example of a device is depicted and generally designated 2100. In various aspects, the device 2100 may have fewer or more components than illustrated in FIG. 21. In an illustrative aspect, the device 2100 may correspond to the device 100 of FIG. 1, the device 200 of FIG. 2, the device 300 of FIG. 3, or a combination thereof. In an illustrative aspect, the device 2100 may perform one or more operations described with reference to systems and methods of FIGS. 1-20.

In a particular aspect, the device 2100 includes a processor 2104 (e.g., a central processing unit (CPU)). The device 2100 may include one or more additional processors 2106 (e.g., one or more digital signal processors (DSPs)). The processor 2104 or the processors 2106 may include or execute instructions 2116 from a memory 2114 to initiate, control or perform operations of the wind turbulence noise reduction engine 106, the spatial audio converter 110, the spatial-audio wind noise reduction processor 114, the spatial audio converter 118, the ambient noise suppressor 122, or a combination thereof.

The device 2100 may include a modem 2130 coupled to a transceiver 2132 and an antenna 2122. The transceiver 2132 may include a receiver, a transmitter, or both. The processor 2104, the processors 2106, or both, are coupled via the modem 2130 to the transceiver 2132.

The device 2100 may include a display 2140 coupled to a display controller 2118. The speaker(s) 126 and the microphones 102 may be coupled, via one or more interfaces, to a CODEC 2108. The CODEC 2108 may include a digital-to-analog converter (DAC) 2110 and an analog-to-digital converter (ADC) 2112.

The memory 2114 may store the instructions 2116, which are executable by the processor 2104, the processors 2106, another processing unit of the device 2100, or a combination thereof, to perform one or more operations described with reference to FIGS. 1-20. The memory 2114 may store data, one or more signals, one or more parameters, one or more thresholds, one or more indicators, or a combination thereof, described with reference to FIGS. 1-20.

One or more components of the device 2100 may be implemented via dedicated hardware (e.g., circuitry), by a processor (e.g., the processor 2104 or the processors 2106) executing the instructions 2116 to perform one or more tasks, or a combination thereof. As an example, the memory 2114 may include or correspond to a memory device (e.g., a computer-readable storage device), such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include (e.g., store) instructions (e.g., the instructions 2116) that, when executed by a computer (e.g., one or more processors, such the processor 2104 and/or the processors 2106), may cause the computer to perform one or more operations described with reference to FIGS. 1-20. As an example, the memory 2114 or one or more components of the processor 2104 and/or the processors 2106 may be a non-transitory computer-readable medium that includes instructions (e.g., the instructions 2116) that, when executed by a computer (e.g., one or more processors, such as the processor 2104 and/or the processors 2106), cause the computer to perform one or more operations described with reference to FIGS. 1-20.

In a particular aspect, the device 2100 may be included in a system-in-package or system-on-chip device 2102. In a particular aspect, the processor 2104, the processors 2106, the display controller 2118, the memory 2114, the CODEC 2108, the modem 2130, and the transceiver 2132 are included in the system-in-package or system-on-chip device 2102. In a particular aspect, an input device 2124, such as a touchscreen and/or keypad, and a power supply 2120 are coupled to the system-in-package or system-on-chip device 2102. Moreover, in a particular aspect, as illustrated in FIG. 21, the display 2140, the input device 2124, the speaker(s) 126, the microphones 102, the antenna 2122, and the power supply 2120 are external to the system-in-package or system-on-chip device 2102. However, each of the display 2140, the input device 2124, the speaker(s) 126, the microphones 102, the antenna 2122, and the power supply 2120 can be coupled to a component of the system-in-package or system-on-chip device 2102, such as an interface or a controller.

The device 2100 may include a wireless telephone, a mobile communication device, a mobile device, a mobile phone, a smart phone, a cellular phone, a virtual reality headset, an augmented reality headset, a mixed reality headset, a vehicle (e.g., a car), a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, earbuds, an audio headset (e.g., headphones), or any combination thereof.

It should be noted that various functions performed by the one or more components of the systems described with reference to FIGS. 1-20 and the device 2100 are described as being performed by certain components or modules. This division of components and modules is for illustration only. In an alternate aspect, a function performed by a particular component or module may be divided amongst multiple components or modules. Moreover, in an alternate aspect, two or more components or modules described with reference to FIGS. 1-21 may be integrated into a single component or module. Each component or module described with reference to FIGS. 1-21 may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described implementations, an apparatus includes means for determining spatial audio data based on audio signals representing sound captured by at least three microphones. For example, the means for determining spatial audio data includes the device 100, the spatial audio converter 110, the integrated circuit 602, the processor(s) 608, the device 2100, the processor 2104, the processor(s) 2106, one or more other circuits or components configured to determine spatial audio data, or any combination thereof.

The apparatus also includes means for determining a metric indicative of wind noise in the audio signals, where the metric is based on a comparison of a first value and a second value, where the first value corresponds to an aggregate signal based on the spatial audio data and the second value corresponds to a differential signal based on the spatial audio data. For example, the means for determining the metric includes the device 100, the spatial-audio wind noise reduction processor 114, the device 200, the device 300, the integrated circuit 602, the processor(s) 608, the integrated circuit 702, the processor(s) 708, the device 2100, the processor 2104, the processor(s) 2106, one or more other circuits or components configured to determine the metric, or any combination thereof.

In some implementations, the apparatus also includes means for modifying the spatial audio data based on the metric to generate reduced-wind-noise audio data. For example, the means for modifying the spatial audio data includes the device 100, the spatial-audio wind noise reduction processor 114, the device 200, the device 300, the integrated circuit 602, the processor(s) 608, the integrated circuit 702, the processor(s) 708, the device 2100, the processor 2104, the processor(s) 2106, one or more other circuits or components configured to modify the spatial audio data, or any combination thereof.

Those of skill would further appreciate that the various illustrative logical blocks, configurations, modules, circuits, and algorithm steps described in connection with the implementations disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, such implementation decisions are not to be interpreted as causing a departure from the scope of the present disclosure.

The steps of a method or algorithm described in connection with the implementations disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor may read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

Particular aspects of the disclosure are described below in a first set of interrelated clauses:

According to Clause 1 a device includes one or more processors configured to: obtain audio signals representing sound captured by at least three microphones; determine spatial audio data based on the audio signals; and determine a metric indicative of wind noise in the audio signals, the metric based on a comparison of a first value and a second value, where the first value corresponds to an aggregate signal based on the spatial audio data and the second value corresponds to a differential signal based on the spatial audio data.

Clause 2 includes the device of Clause 1 where the one or more processors are further configured to modify the spatial audio data based on the metric to generate reduced-wind-noise audio data.

Clause 3 includes the device of Clause 2 where the one or more processors are further configured to generate binaural audio output based on the reduced-wind-noise audio data and to perform ambient noise suppression of the binaural audio output.

Clause 4 includes the device of Clause 2 where modifying the spatial audio data based on the metric to generate the reduced-wind-noise audio data comprises filtering the spatial audio data using filter parameters based on the metric to reduce low frequency noise associated with wind.

Clause 5 includes the device of Clause 2 where modifying the spatial audio data based on the metric to generate the reduced-wind-noise audio data comprises reducing a gain applied to one or more spatial audio channels of the spatial audio data.

Clause 6 includes the device of any of Clauses 1 to 5 where determining the spatial audio data based on the audio signals comprises spatially filtering the audio signals to generate multiple beamformed audio channels.

Clause 7 includes the device of Clause 6 where the aggregate signal is based on signal power of a sum of multiple angularly offset beamformed audio channels of the multiple beamformed audio channels and the differential signal is based on signal power of a difference of the multiple angularly offset beamformed audio channels.

Clause 8 includes the device of Clause 7 where the multiple angularly offset beamformed audio channels are angularly offset by at least 90 degrees.

Clause 9 includes the device of any of Clauses 1 to 8 where determining the spatial audio data based on the audio signals comprises determining ambisonics coefficients based on the audio signals to generate multiple ambisonics channels.

Clause 10 includes the device of Clause 9 where the aggregate signal is based on signal power of an omnidirectional ambisonics channel of the multiple ambisonics channels and the differential signal is based on signal power of a directional ambisonics channel of the multiple ambisonics channels.

Clause 11 includes the device of any of Clauses 1 to 10 where the metric indicative of wind noise in the audio signals is determined for one or more frequency bands that are less than a threshold frequency.

Clause 12 includes the device of any of Clauses 1 to 11 where determining the metric indicative of wind noise in the audio signals comprises determining frequency-specific values of the metric for a set of frequencies, and where the one or more processors are further configured to cause a gain applied to one or more spatial audio channels to be reduced based on a determination that at least one of the frequency-specific values satisfies a wind detection criterion.

Clause 13 includes the device of Clause 12 where the one or more processors are configured to cause the gain to be reduced gradually over multiple frames of the spatial audio data associated with the one or more spatial audio channels.

Clause 14 includes the device of Clause 12 where the one or more spatial audio channels to which the gain is applied correspond to a front-to-back direction and an up-and-down direction, and where applying the gain reduces low-band audio corresponding the front-to-back direction and the up-and-down direction during playback.

Clause 15 includes the device of any of Clauses 1 to 14 where determining the metric indicative of wind noise in the audio signals comprises, for each frequency band of a set of frequency bands, determining a band-specific value of the metric.

Clause 16 includes the device of Clause 15 where the one or more processors are further configured to modify a particular band-specific value of the metric for a particular frequency band based on determining that the particular band-specific value of the metric satisfies an acceptance criterion.

Clause 17 includes the device of Clause 15 where the one or more processors are further configured to apply a wind-reduction parameter to multiple frequency-specific values of the metric to determine the band-specific value of the metric.

Clause 18 includes the device of Clause 15 where the one or more processors are further configured to adjust one or more of the band-specific values of the metric to prevent a gain-adjusted power of a higher frequency band of the set of frequency bands from exceeding a gain-adjusted energy of a lower frequency band of the set of frequency bands.

Clause 19 includes the device of Clause 15 where the one or more processors are further configured to filter the spatial audio data using filter parameters based on the metric to generate reduced-wind-noise audio data.

Clause 20 includes the device of any of Clauses 1 to 19 where the one or more processors are further configured to, before determining the spatial audio data, process the audio signals to remove high frequency wind noise.

Clause 21 includes the device of any of Clauses 1 to 20 and further includes the at least three microphones, where at least two microphones of the at least three microphones are spaced at least 0.5 centimeters apart.

Clause 22 includes the device of any of Clauses 1 to 21 and further includes the at least three microphones, where at least two microphones of the at least three microphones are spaced at least 2 centimeters apart.

Clause 23 includes the device of any of Clauses 1 to 22 where the one or more processors are integrated within a mobile communication device.

Clause 24 includes the device of any of Clauses 1 to 23 where the one or more processors are integrated within a vehicle.

Clause 25 includes the device of any of Clauses 1 to 24 where the one or more processors are integrated within one or more of an augmented reality headset, a mixed reality headset, a virtual reality headset, or a wearable device.

Clause 26 includes the device of any of Clauses 1 to 25 where the one or more processors are included in an integrated circuit.

According to Clause 27 a method includes obtaining audio signals representing sound captured by at least three microphones; determining spatial audio data based on the audio signals; and determining a metric indicative of wind noise in the audio signals, the metric based on a comparison of a first value and a second value, where the first value corresponds to an aggregate signal based on the spatial audio data and the second value corresponds to a differential signal based on the spatial audio data.

Clause 28 includes the method of Clause 27 and further includes modifying the spatial audio data based on the metric to generate reduced-wind-noise audio data.

Clause 29 includes the method of Clause 28 and further includes generating binaural audio output based on the reduced-wind-noise audio data and performing ambient noise suppression of the binaural audio output.

Clause 30 includes the method of Clause 28 where modifying the spatial audio data based on the metric to generate the reduced-wind-noise audio data comprises filtering the spatial audio data using filter parameters based on the metric to reduce low frequency noise associated with wind.

Clause 31 includes the method of Clause 28 where modifying the spatial audio data based on the metric to generate the reduced-wind-noise audio data comprises reducing a gain applied to one or more spatial audio channels of the spatial audio data.

Clause 32 includes the method of any of Clauses 27 to 31 where determining the spatial audio data based on the audio signals comprises spatially filtering the audio signals to generate multiple beamformed audio channels.

Clause 33 includes the method of Clause 32 where the aggregate signal is based on signal power of a sum of multiple angularly offset beamformed audio channels of the multiple beamformed audio channels and the differential signal is based on signal power of a difference of the multiple angularly offset beamformed audio channels.

Clause 34 includes the method of Clause 33 where the multiple angularly offset beamformed audio channels are angularly offset by at least 90 degrees.

Clause 35 includes the method of any of Clauses 27 to 34 where determining the spatial audio data based on the audio signals comprises determining ambisonics coefficients based on the audio signals to generate multiple ambisonics channels.

Clause 36 includes the method of Clause 35 where the aggregate signal is based on signal power of an omnidirectional ambisonics channel of the multiple ambisonics channels and the differential signal is based on signal power of a directional ambisonics channel of the multiple ambisonics channels.

Clause 37 includes the method of any of Clauses 27 to 36 where the metric indicative of wind noise in the audio signals is determined for one or more frequency bands that are less than a threshold frequency.

Clause 38 includes the method of any of Clauses 27 to 37 where determining the metric indicative of wind noise in the audio signals comprises determining frequency-specific values of the metric for a set of frequencies, and further comprising reducing a gain applied to one or more spatial audio channels based on a determination that at least one of the frequency-specific values satisfies a wind detection criterion.

Clause 39 includes the method of Clause 38 where the gain is reduced gradually over multiple frames of the spatial audio data associated with the one or more spatial audio channels.

Clause 40 includes the method of Clause 38 where the one or more spatial audio channels to which the gain is applied correspond to a front-to-back direction and an up-and-down direction, and where applying the gain reduces low-band audio corresponding the front-to-back direction and the up-and-down direction during playback.

Clause 41 includes the method of any of Clauses 27 to 40 where determining the metric indicative of wind noise in the audio signals comprises, for each frequency band of a set of frequency bands, determining a band-specific value of the metric.

Clause 42 includes the method of Clause 41 and further includes modifying a particular band-specific value of the metric for a particular frequency band based on determining that the particular band-specific value of the metric satisfies an acceptance criterion.

Clause 43 includes the method of Clause 41 and further includes applying a wind-reduction parameter to multiple frequency-specific values of the metric to determine the band-specific value of the metric.

Clause 44 includes the method of Clause 41 and further includes adjusting one or more of the band-specific values of the metric to prevent a gain-adjusted power of a higher frequency band of the set of frequency bands from exceeding a gain-adjusted energy of a lower frequency band of the set of frequency bands.

Clause 45 includes the method of Clause 41 and further includes filtering the spatial audio data using filter parameters based on the metric to generate reduced-wind-noise audio data.

Clause 46 includes the method of any of Clauses 27 to 45 and further includes, before determining the spatial audio data, processing the audio signals to remove high frequency wind noise.

Clause 47 includes the method of any of Clauses 27 to 46 where at least two microphones of the at least three microphones are spaced at least 0.5 centimeters apart.

Clause 48 includes the method of any of Clauses 27 to 47 where at least two microphones of the at least three microphones are spaced at least 2 centimeters apart.

According to Clause 49 a device includes means for determining spatial audio data based on audio signals representing sound captured by at least three microphones and means for determining a metric indicative of wind noise in the audio signals, the metric based on a comparison of a first value and a second value, where the first value corresponds to an aggregate signal based on the spatial audio data and the second value corresponds to a differential signal based on the spatial audio data.

Clause 50 includes the device of Clause 49 and further includes means for modifying the spatial audio data based on the metric to generate reduced-wind-noise audio data.

Clause 51 includes the device of Clause 50 and further includes means for generating binaural audio output based on the reduced-wind-noise audio data and further comprising means for performing ambient noise suppression of the binaural audio output.

Clause 52 includes the device of Clause 50 where modifying the spatial audio data based on the metric to generate the reduced-wind-noise audio data comprises filtering the spatial audio data using filter parameters based on the metric to reduce low frequency noise associated with wind.

Clause 53 includes the device of Clause 50 where modifying the spatial audio data based on the metric to generate the reduced-wind-noise audio data comprises reducing a gain applied to one or more spatial audio channels of the spatial audio data.

Clause 54 includes the device of any of Clauses 49 to 53 where determining the spatial audio data based on the audio signals comprises spatially filtering the audio signals to generate multiple beamformed audio channels.

Clause 55 includes the device of Clause 54 where the aggregate signal is based on signal power of a sum of multiple angularly offset beamformed audio channels of the multiple beamformed audio channels and the differential signal is based on signal power of a difference of the multiple angularly offset beamformed audio channels.

Clause 56 includes the device of Clause 55 where the multiple angularly offset beamformed audio channels are angularly offset by at least 90 degrees.

Clause 57 includes the device of any of Clauses 49 to 56 where determining the spatial audio data based on the audio signals comprises determining ambisonics coefficients based on the audio signals to generate multiple ambisonics channels.

Clause 58 includes the device of Clause 57 where the aggregate signal is based on signal power of an omnidirectional ambisonics channel of the multiple ambisonics channels and the differential signal is based on signal power of a directional ambisonics channel of the multiple ambisonics channels.

Clause 59 includes the device of any of Clauses 49 to 58 where the metric indicative of wind noise in the audio signals is determined for one or more frequency bands that are less than a threshold frequency.

Clause 60 includes the device of any of Clauses 49 to 59 where determining the metric indicative of wind noise in the audio signals comprises determining frequency-specific values of the metric for a set of frequencies, and further include means for reducing a gain applied to one or more spatial audio channels based on a determination that at least one of the frequency-specific values satisfies a wind detection criterion.

Clause 61 includes the device of Clause 60 where the means for reducing the gain is configured to reduce the gain gradually over multiple frames of the spatial audio data associated with the one or more spatial audio channels.

Clause 62 includes the device of Clause 60 where the one or more spatial audio channels to which the gain is applied correspond to a front-to-back direction and an up-and-down direction, and where applying the gain reduces low-band audio corresponding the front-to-back direction and the up-and-down direction during playback.

Clause 63 includes the device of any of Clauses 49 to 62 where determining the metric indicative of wind noise in the audio signals comprises, for each frequency band of a set of frequency bands, determining a band-specific value of the metric.

Clause 64 includes the device of Clause 63 and further includes means for modifying a particular band-specific value of the metric for a particular frequency band based on determining that the particular band-specific value of the metric satisfies an acceptance criterion.

Clause 65 includes the device of Clause 63 and further includes means for applying a wind-reduction parameter to multiple frequency-specific values of the metric to determine the band-specific value of the metric.

Clause 66 includes the device of Clause 63 and further includes means for adjusting one or more of the band-specific values of the metric to prevent a gain-adjusted power of a higher frequency band of the set of frequency bands from exceeding a gain-adjusted energy of a lower frequency band of the set of frequency bands.

Clause 67 includes the device of Clause 63 and further includes means for filtering the spatial audio data using filter parameters based on the metric to generate reduced-wind-noise audio data.

Clause 68 includes the device of any of Clauses 49 to 67 and further includes means for processing the audio signals to remove high frequency wind noise before determining the spatial audio data.

Clause 69 includes the device of any of Clauses 49 to 68 and further includes the at least three microphones, where at least two microphones of the at least three microphones are spaced at least 0.5 centimeters apart.

Clause 70 includes the device of any of Clauses 49 to 69 and further includes the at least three microphones, where at least two microphones of the at least three microphones are spaced at least 2 centimeters apart.

Clause 71 includes the device of any of Clauses 49 to 70 where the means for determining the spatial audio data and the means for determining the metric are integrated within a mobile computing device.

Clause 72 includes the device of any of Clauses 49 to 71 where the means for determining the spatial audio data and the means for determining the metric are integrated within a vehicle.

Clause 73 includes the device of any of Clauses 49 to 72 where the means for determining the spatial audio data and the means for determining the metric are integrated within one or more of an augmented reality headset, a mixed reality headset, a virtual reality headset, or a wearable device.

Clause 74 includes the device of any of Clauses 49 to 73 where the means for determining the spatial audio data and the means for determining the metric are included in an integrated circuit.

According to Clause 75 a computer-readable storage device stores instructions that are executable by one or more processors to cause the one or more processors to determine spatial audio data based on audio signals representing sound captured by at least three microphones and to determine a metric indicative of wind noise in the audio signals, the metric based on a comparison of a first value and a second value, where the first value corresponds to an aggregate signal based on the spatial audio data and the second value corresponds to a differential signal based on the spatial audio data.

Clause 76 includes the computer-readable storage device of Clause 75 where the instructions are further executable to modify the spatial audio data based on the metric to generate reduced-wind-noise audio data.

Clause 77 includes the computer-readable storage device of Clause 76 where the instructions are further executable to generate binaural audio output based on the reduced-wind-noise audio data and performing ambient noise suppression of the binaural audio output.

Clause 78 includes the computer-readable storage device of Clause 76 where modifying the spatial audio data based on the metric to generate the reduced-wind-noise audio data comprises filtering the spatial audio data using filter parameters based on the metric to reduce low frequency noise associated with wind.

Clause 79 includes the computer-readable storage device of Clause 76 where modifying the spatial audio data based on the metric to generate the reduced-wind-noise audio data comprises reducing a gain applied to one or more spatial audio channels of the spatial audio data.

Clause 80 includes the computer-readable storage device of any of Clauses 75 to 79 where determining the spatial audio data based on the audio signals comprises spatially filtering the audio signals to generate multiple beamformed audio channels.

Clause 81 includes the computer-readable storage device of Clause 80 where the aggregate signal is based on signal power of a sum of multiple angularly offset beamformed audio channels of the multiple beamformed audio channels and the differential signal is based on signal power of a difference of the multiple angularly offset beamformed audio channels.

Clause 82 includes the computer-readable storage device of Clause 81 where the multiple angularly offset beamformed audio channels are angularly offset by at least 90 degrees.

Clause 83 includes the computer-readable storage device of any of Clauses 75 to 82 where determining the spatial audio data based on the audio signals comprises determining ambisonics coefficients based on the audio signals to generate multiple ambisonics channels.

Clause 84 includes the computer-readable storage device of Clause 83 where the aggregate signal is based on signal power of an omnidirectional ambisonics channel of the multiple ambisonics channels and the differential signal is based on signal power of a directional ambisonics channel of the multiple ambisonics channels.

Clause 85 includes the computer-readable storage device of any of Clauses 75 to 84 where the metric indicative of wind noise in the audio signals is determined for one or more frequency bands that are less than a threshold frequency.

Clause 86 includes the computer-readable storage device of any of Clauses 75 to 85 where determining the metric indicative of wind noise in the audio signals comprises determining frequency-specific values of the metric for a set of frequencies, and where the instructions are further executable to reduce a gain applied to one or more spatial audio channels based on a determination that at least one of the frequency-specific values satisfies a wind detection criterion.

Clause 87 includes the computer-readable storage device of Clause 86 where the gain is reduced gradually over multiple frames of the spatial audio data associated with the one or more spatial audio channels.

Clause 88 includes the computer-readable storage device of Clause 86 where the one or more spatial audio channels to which the gain is applied correspond to a front-to-back direction and an up-and-down direction, and where applying the gain reduces low-band audio corresponding the front-to-back direction and the up-and-down direction during playback.

Clause 89 includes the computer-readable storage device of any of Clauses 75 to 88 where determining the metric indicative of wind noise in the audio signals comprises, for each frequency band of a set of frequency bands, determining a band-specific value of the metric.

Clause 90 includes the computer-readable storage device of Clause 89 where the instructions are further executable to modify a particular band-specific value of the metric for a particular frequency band based on determining that the particular band-specific value of the metric satisfies an acceptance criterion.

Clause 91 includes the computer-readable storage device of Clause 89 where the instructions are further executable to apply a wind-reduction parameter to multiple frequency-specific values of the metric to determine the band-specific value of the metric.

Clause 92 includes the computer-readable storage device of Clause 89 where the instructions are further executable to adjust one or more of the band-specific values of the metric to prevent a gain-adjusted power of a higher frequency band of the set of frequency bands from exceeding a gain-adjusted power of a lower frequency band of the set of frequency bands.

Clause 93 includes the computer-readable storage device of Clause 89 where the instructions are further executable to filter the spatial audio data using filter parameters based on the metric to generate reduced-wind-noise audio data.

Clause 94 includes the computer-readable storage device of any of Clauses 75 to 93 where the instructions are further executable to, before determining the spatial audio data, process the audio signals to remove high frequency wind noise.

Clause 95 includes the computer-readable storage device of any of Clauses 75 to 94 where at least two microphones of the at least three microphones are spaced at least 0.5 centimeters apart.

Clause 96 includes the computer-readable storage device of any of Clauses 75 to 95 where at least two microphones of the at least three microphones are spaced at least 2 centimeters apart.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A device comprising:

one or more processors configured to:

obtain audio signals representing sound captured by at least three microphones;

determine spatial audio data based on the audio signals;

determine a metric indicative of wind noise in the audio signals, the metric based on (a) a comparison of a first value and a second value, wherein the first value corresponds to an aggregate signal based on the spatial audio data and the second value corresponds to a differential signal based on the spatial audio data, and (b) a gain applied to one or more spatial audio channels to be reduced based on a determination that at least one of frequency-specific values of the metric satisfies a wind detection criterion, wherein the one or more spatial audio channels to which the gain is applied correspond to a first-to-second direction; and reduces audio output corresponding the first-to-second direction.

2. The device of claim 1, wherein the one or more processors are further configured to modify the spatial audio data based on the metric to generate reduced-wind-noise audio data.

3. The device of claim 2, wherein modifying the spatial audio data based on the metric to generate the reduced-wind-noise audio data comprises filtering the spatial audio data using filter parameters based on the metric to reduce low frequency noise associated with wind.

4. The device of claim 2, wherein modifying the spatial audio data based on the metric to generate the reduced-wind-noise audio data comprises reducing a gain applied to one or more spatial audio channels of the spatial audio data.

5. The device of claim 1, wherein the first-to-second direction is a front-to-back-direction.

6. The device of claim 1, wherein the first-to-second direction is an up-and-down direction.

7. The device of claim 1, further comprising the at least three microphones, wherein at least two microphones of the at least three microphones are spaced at least 0.5 centimeters apart.

8. The device of claim 1, further comprising the at least three microphones, wherein at least two microphones of the at least three microphones are spaced at least 2 centimeters apart.

9. The device of claim 1, wherein the one or more processors are integrated within a mobile computing device.

10. The device of claim 1, wherein the one or more processors are integrated within a vehicle.

11. The device of claim 1, wherein the one or more processors are integrated within one or more of an augmented reality headset, a mixed reality headset, a virtual reality headset, or a wearable device.

12. Device of claim 1, wherein the one or more processors are included in an integrated circuit.

13. A method comprising:

obtaining audio signals representing sound captured by at least three microphones;

determining spatial audio data based on the audio signals; and determining a metric indicative of wind noise in the audio signals, the metric based on a comparison of a first value and a second value, wherein the first value corresponds to an aggregate signal based on the spatial audio data and the second value corresponds to a differential signal based on the spatial audio data, wherein the determining the spatial audio data based on the audio signals comprises determining ambisonics coefficients based on the audio signals to generate multiple ambisonics channels.

14. The method of claim 13, further comprising modifying the spatial audio data based on the metric to generate reduced-wind-noise audio data.

15. The method of claim 14, further comprising generating binaural audio output based on the reduced-wind-noise audio data and performing ambient noise suppression of the binaural audio output.

16. The method of claim 14, wherein modifying the spatial audio data based on the metric to generate the reduced-wind-noise audio data comprises filtering the spatial audio data using filter parameters based on the metric to reduce low frequency noise associated with wind.

17. The method of claim 14, wherein modifying the spatial audio data based on the metric to generate the reduced-wind-noise audio data comprises reducing a gain applied to one or more spatial audio channels of the spatial audio data.

18. The method of claim 13, wherein determining the spatial audio data based on the audio signals comprises spatially filtering the audio signals to generate multiple beamformed audio channels.

19. The method of claim 18, wherein the aggregate signal is based on signal power of a sum of multiple angularly offset beamformed audio channels of the multiple beamformed audio channels and the differential signal is based on signal power of a difference of the multiple angularly offset beamformed audio channels.

20. The method of claim 19, wherein the multiple angularly offset beamformed audio channels are angularly offset by at least 90 degrees.

21. The method of claim 13, wherein the aggregate signal is based on signal power of an omnidirectional ambisonics channel of the multiple ambisonics channels and the differential signal is based on signal power of a directional ambisonics channel of the multiple ambisonics channels.

22. The method of claim 13, wherein determining the metric indicative of wind noise in the audio signals comprises determining frequency-specific values of the metric for a set of frequencies, and further comprising reducing a gain applied to one or more spatial audio channels based on a determination that at least one of the frequency-specific values satisfies a wind detection criterion.

23. The method of claim 13, wherein determining the metric indicative of wind noise in the audio signals comprises, for each frequency band of a set of frequency bands, determining a band-specific value of the metric.

24. The method of claim 13, further comprising:

modifying a particular band-specific value of the metric for a particular frequency band based on determining that the particular band-specific value of the metric satisfies an acceptance criterion; and adjusting one or more of the band-specific values of the metric to prevent a gain-adjusted power of a higher frequency band of the set of frequency bands from exceeding a gain-adjusted energy of a lower frequency band of the set of frequency bands.

25. The method of claim 23, further comprising filtering the spatial audio data using filter parameters based on the metric to generate reduced-wind-noise audio data.

26. The method of claim 13, further comprising, before determining the spatial audio data, processing the audio signals to remove high frequency wind noise.

27. A device comprising:

means for determining spatial audio data based on audio signals representing sound captured by at least three microphones; and means for determining a metric indicative of wind noise in the audio signals, the metric based on a comparison of a first value and a second value, wherein the first value corresponds to an aggregate signal based on the spatial audio data and the second value corresponds to a differential signal based on the spatial audio data, wherein the determining the spatial audio data based on the audio signals comprises determining ambisonics coefficients based on the audio signals to generate multiple ambisonics channels.

28. The device of claim 27, further comprising means for modifying the spatial audio data based on the metric to generate reduced-wind-noise audio data.

29. A non-transitory computer-readable storage device storing instructions that are executable by one or more processors to cause the one or more processors to:

determine spatial audio data based on audio signals representing sound captured by at least three microphones; and determine a metric indicative of wind noise in the audio signals, the metric based on a comparison of a first value and a second value, wherein the first value corresponds to an aggregate signal based on the spatial audio data and the second value corresponds to a differential signal based on the spatial audio data, wherein the determine the spatial audio data based on the audio signals comprises determining ambisonics coefficients based on the audio signals to generate multiple ambisonics channels.

* * * * *